US007210513B2

(12) United States Patent
Goldenberg et al.

(10) Patent No.: US 7,210,513 B2
(45) Date of Patent: May 1, 2007

(54) SCREEN FRAME WITH INTEGRAL ROLL SCREEN COMPARTMENT AND IMPROVEMENTS THEREOF

(75) Inventors: Shaul Goldenberg, Vaughan (CA); Sean Davies, Vaughan (CA); Sinnathamby Kupenthirarajan, Vaughan (CA)

(73) Assignee: 420820 Ontario Limited, Vaughan, Ontario (CA)

( * ) Notice: Subject to any disclaimer, the term of this patent is extended or adjusted under 35 U.S.C. 154(b) by 220 days.

(21) Appl. No.: 10/785,009

(22) Filed: Feb. 25, 2004

(65) Prior Publication Data

US 2004/0216849 A1 Nov. 4, 2004

Related U.S. Application Data

(63) Continuation-in-part of application No. 10/115,084, filed on Apr. 4, 2002, now Pat. No. 6,701,994.

(30) Foreign Application Priority Data

Oct. 22, 2001 (CA) ..... 2359549

(51) Int. Cl.
*E06B 9/40* (2006.01)

(52) U.S. Cl. ..... 160/31; 160/296; 160/381

(58) Field of Classification Search ..... 160/31, 160/296, 381, 273.1, 297, 299, 301, 305, 160/304.1

See application file for complete search history.

(56) References Cited

U.S. PATENT DOCUMENTS 1,612,261 A * 12/1926 Burns ..... 160/273.1
2,517,514 A * 8/1950 Walsh ..... 160/31
4,188,992 A 2/1980 Segerljung ..... 160/296
4,513,805 A * 4/1985 Mase ..... 160/299
4,838,333 A 6/1989 Mottura ..... 160/305
4,915,152 A * 4/1990 Magee ..... 160/31
5,099,906 A 3/1992 Chigusa et al. ..... 160/297
5,479,979 A 1/1996 Hayashiguchi ..... 160/265
5,547,011 A * 8/1996 Dotson et al. ..... 160/381
5,853,040 A * 12/1998 Benthin ..... 160/299
5,934,353 A 8/1999 Buhr ..... 160/269
6,070,642 A 6/2000 Douglas et al. ..... 160/310
6,082,432 A 7/2000 Kissinger ..... 160/290.1
6,155,328 A * 12/2000 Welfonder ..... 160/313
6,167,936 B1 1/2001 Stover et al. ..... 160/27
6,267,168 B1 7/2001 Davies et al. ..... 160/23.1

(Continued)

*Primary Examiner*—David Purol
(74) *Attorney, Agent, or Firm*—Ivor M. Hughes; Neil Hughes; Francis Ng-Cheng-Hin

(57) ABSTRACT

A sliding screen frame for a closure assembly having an opening and an existing track for mounting a screen, the screen frame has framing sections with both inner and outer side edges, and a housing from which a screen is payed out and accumulated. The framing sections are adapted on the outer side edge to interfit with the existing track of the closure assembly to enable the sliding screen frame to slide across the opening of the closure assembly and the frame sections also being adapted on the inner side edge thereof to support and guide the free end of the screen between a fully payed out and a fully accumulated position. The screen frame has a mitreless corner connector for connecting adjacent framing sections without the need for mitre cuts thereof to establish continuity between the corner connector and the adjacent framing sections.

24 Claims, 35 Drawing Sheets

U.S. PATENT DOCUMENTS 6,408,922 B2 * 6/2002 Desrochers ..... 160/24
6,478,070 B2 * 11/2002 Poppema ..... 160/23.1
6,591,890 B1 * 7/2003 Grubb et al. ..... 160/296
6,701,994 B2 * 3/2004 Goldenberg et al. ..... 160/31
6,851,464 B2 * 2/2005 Hudoba et al. ..... 160/31
6,938,667 B2 * 9/2005 Sugiyama et al. ..... 160/296

* cited by examiner

SCREEN FRAME WITH INTEGRAL ROLL SCREEN COMPARTMENT AND IMPROVEMENTS THEREOF

This is a continuation-in-part of US application Ser. No. 10/115,084 filed Apr. 4, 2002, now U.S. Pat. No. 6,701,994 B2.

FIELD OF THE INVENTION

This invention relates to improvements to screens for closure assemblies and in a preferred embodiment for patio doors, and windows.

BACKGROUND OF THE INVENTION

In the art there exists numerous devices which provide screening to prevent insects from entering open windows and patio doors. These screening devices may be placed in position within a channel provided with the frame sections of typical window or door assemblies with the screen frame of a predetermined thickness so as to easily fit within the channel. Patio door screens may be slideable in a channel on a track assisted by rollers and moveable to and from the position wherein the screen blocks the opening when the door is in the open position and prevents insects from entering the dwelling, to a position away from the opening wherein the screen does not block the opening.

More recently, roll out screen assemblies have been provided which include after-market products which are permanently fixed in position on or near an exterior frame section adjacent to the door opening. At this position when desired the screen may be rolled out from its housing at a fixed position and extend across the door opening when the door is in an open position. The screen of course may be accumulated on a roller in the housing and thereby provide the occupant with a clear unobstructed view of their yard. But such a construction has difficulty in providing an adequate barrier to insects. They are unsightly and are also costly and may be beyond the level of skill for a homeowner installation.

Other efforts therefore have been made to make roll screen constructions more invisible and yet functional. Such constructions may be found in Applicant's prior granted patent, U.S. Pat. No. 6,267,168 which teaches the use of a roll screen cassette contained within a framing section of a closure assembly which provides guides in the header and sill frames for the leading edge of the roll screen. This construction improves the barrier against insects but raises other issues. Applicant is also aware of U.S. Pat. No. 6,167,936 that addresses a similar concept. However, such hidden constructions do require that the window frames be manufactured to required specifications to include a void wherein the roll screen may be inserted. Conceptually these patents provide a valuable approach but in one respect from an economic standpoint they require that existing window constructions be re-tooled for the required framing sections with the void for the hidden screen. Most manufacturers do not want to do this because of the cost of moulds and dies. There is therefore, still an unmet need yet unsatisfied which provides a screen construction which does not require an extensive amount of re-tooling.

Attempts have been made to provide roll screen constructions within its own frame for fastening to an existing window or door frame; for example, U.S. Pat. No. 5,479,979; U.S. Pat. No. 6,082,432; and finally U.S. Pat. No. 6,070,642. Particularly referring to U.S. Pat. No. 6,070,642 as by way of example, there is taught a roll screen assembly which has a support frame which is fixed into position with the upper member (30), as best seen in FIGS. 1 and 2, including a compartment wherein the roll screen accumulates and pays out. The entire frame section therefore is fixed into position upon a typical frame for a door or a window which is adapted to the existing framing structure proximate the inner peripheral of the window or door frame. The roll screen frame is permanently fixed in position therefore and does not utilize any existing mounting portions available with the homeowner's windows or doors. Further in the case of a patio door the roll screen frame does provide an obstacle at the threshold which will be discussed hereinafter.

Another example is found in such a fixed structure in relation to U.S. Pat. No. 6,082,432 wherein the roll screen frame, as best seen in FIGS. 1 and 2, is fixed in position and the roll screen is also fixed in position within the chamber compartment (40) on the brackets (41 and 46) wherein the screen pays out and accumulates. The handle portion or as it is referred to in the patent, the pulling posts (25) extends across the frame portions (28 and 28*b*) which are positioned in fixed relationship to span the door. Nothing within the reference teaches that the frame section supporting the roll screen may also move in relation to the door in a sliding motion as is with a typical planar screen door for a patio door (which typical screen does not include a roll screen component).

Some of the problems experienced with these prior art constructions include, with respect to the roll out doors, that a framing section is provided at the threshold of the assembly. This is true, for example, for screen doors manufactured by the Phantom Manufacturing Limited under the trademark "PHANTOM"™ and by Monroe Tool and Die, and/or KSG Products for "MIRAGE"™ door screens. Typically, these products resemble U.S. Pat. No. 6,082,432 and require supplementary frame sections that extend around the door assembly which provide the obstacle adjacent to the threshold of the assembly. When the roll out screen is accumulated into the roll tube housing, the threshold remains as an obstacle to block the egress of an individual and particularly for those using wheel chairs, walkers and the like. People without particular challenges may simply step on the threshold obstacle and disform it to prevent the screen from rolling out and requiring an expensive repair. Further, such installations require expensive labour for installation and may be quite expensive in comparison to a typical sliding screen door which is not fixed in position.

When attempting to join the framing sections for a conventional frame such as those described above, it is the convention to have mitre joints at 45° angles on the individual framing sections so that each section meets flush. These sections are attached to one another with the use of a "L" shaped connector or bracket. Such a joint is established and the adjacent sections being joined, as seen in applicants own Ser. No. 10/115,084, must be cut to a predetermined angle to attach the frames proximate the mitre joints. This requires additional manufacturing time. Attempts have been made to overcome this deficiency by the use of corner brackets such as those disclosed in U.S. Pat. No. 4,827,648. These corners however are intended for engagement with a planar member proximate slots provided in the side members of the corner bracket. However they cannot be used to join adjacent frame sections.

Applicant is also aware of a product SCREEN AWAY™ for retractable roll screen assemblies manufactured by Superior Building Products which provides such a device which includes approximately 18 to 24 parts and 22 steps involved in assembling the kit of components provided. Although the product may be esthetically pleasing once assembled, the threshold obstacle is evident which must be present to provide support for the leading edge of the roll screen as it moves across the opening.

However, a typical known sliding screen frame, for installation adjacent a patio door, when positioned across the patio door opening blocks the occupants view of the yard and may be esthetically displeasing. If the screen door is slid to the opposite position away from the opening then the opposite glass pane is obstructed as well. Typically roll screens have a retraction mechanism in the form of a tensioned spring that biases the screen to the retracted position. Braking detents may be provided with a roll blind which engage and brake the mechanism described in U.S. Pat. No. 4,188,992. However this construction is cumbersome and bulky and provides no compatible simple braking surfaces separate from the shaft provided with a free wheeling bushing and compatible bracket.

U.S. Pat. No. 5,099,906 teaches the use of a centrifugal clutch based braking device that is mounted on the interior of the roll screen which is complicated to assemble and manufacture.

U.S. Pat. No. 4,188,992 above-mentioned also discloses a centrifugally based braking system. This particular braking system is ineffective for vertically oriented screen rolls since the braking action forces are parallel to the screen roll itself and would be counteracted by gravity if mounted vertically.

Another cumbersome braking device for a horizontal system is disclosed in U.S. Pat. No. 4,838,333.

Known roll screens as in the case with the Applicant's prior construction, that pay out horizontally, are not guided in channels except at the ends of the screen near the handle. There are no means of retaining the edges of the screen cloth in place against the forces generated by the wind blowing on the screen. If the wind forces are high enough, this can cause release of the screen from the guide channel that can allow insects to pass. Attempts have been made to overcome this type of problem by providing bead like wind retaining devices attached at the edges of the screen cloth that are carried along a guide or groove contained within the frame. Though solving the problem of securing the motion of the screen at all sides of the framework it poses another problem in that the screen will not properly accumulate on the roll. That is it will not lie flat when accumulated and will tend to go out of round. Further if the beads do not release from the guide channel the screen cloth may be torn resulting in costly repairs occurring when greater forces than that of the wind such as the force of a pet jumping up against the screen. The screen should easily release from the guide channel and not be preventing from properly retracting.

One such example of an attempt to solve this problem is disclosed in U.S. Pat. No. 5,934,353. This solution is overly complicated and requires gripping surfaces within a guide channel to engage the screen edge.

None of the prior art constructions identified above known to Applicants addresses the issue which Applicants' current invention focuses in upon. That is with all of the knowledge of those designing roll out screen assemblies which are bolted in place whether or not in a frame, none of the inventors including Applicant's prior construction take advantage of the existing channels and tracks within windows and patio doors to allow for simplicity of installation to easily fit within known constructions for windows and patio doors.

Applicant therefore is providing a roll screen frame construction, which is standardized at its perimeter to mate and interfit with well known channels, tracks and hardware and improvements thereof including braking mechanisms, wind retainers, and mitreless corners. In doing so the present roll screen design makes replacement and installation much simpler. In spite of the numerous efforts made to provide an acceptable roll screen for windows and doors there still remains a long felt need left unaddressed in the art for a roll screen assembly and improvements thereof which may be simply and easily installed by the homeowner. Nowhere within the prior art is such a roll screen frame provided which may be merchandised as an OEM as well as an after-market product and which will fit the same constraints provided with windows and doors such as for example the well known planar screen frame which slides in a track in a frame adjacent to a patio door. These particular known frames are inexpensive. Further nowhere in the art is there taught, a simplified braking system which is integrated into the roll screen assembly, a simple wind retainer for engaging the edges of the screen cloth at predetermined intervals, a mitreless joint for framing sections, and other components which improve the performance of the roll screen of the parent application.

It is therefore a primary object of the invention to provide a roll screen frame construction, which is standardized at its perimeter to mate and interfit with existing well known channels, tracks and hardware for windows and doors.

It is yet another object of this invention to provide a sliding screen frame with integral roll screen housing which frame may be slid across the opening of a closure frame and which frame is also used to support the free end of the roll out screen as well.

It is another object of the invention to make such a roll out screen assembly affordable.

It is yet a further object of the invention to provide a screen assembly in a fully assembled or alternative knock down kit form which is easy to assemble and/or install.

It is yet a further object of the invention to provide a screen assembly which may be provided as a kit of components.

It is yet a further object of the invention to provide a wind retaining device on the edge of the screen portions cloth to assist with guiding the cloth to and from the retracted position without preventing the screen cloth from accumulating on the screen tube at the fully retracted position.

It is yet a further object of the invention to provide for a corner bracket that obviates the need for mitre joints when joining adjacent framing sections.

It is yet a further object of the invention to provide a simple speed control braking device for the roll screen for substantial elimination of the uncontrolled hazardous rewinding on retraction of the roll screen.

It is yet a further object of the invention to provide a screen assembly which is cost effective.

It is yet a further object of the invention to provide a torque tube designed to improve the interfit thereof with both a screen tube and a support bracket, and further provide braking element guides therewith.

It is still another object of the invention to provide a bracket for carrying both the screen tube and for assembling the screen frame, which provides housing of a speed control braking system.

Further and other objects of the invention will become apparent to those skilled in the art when considering the following summary of the invention and the more detailed description of the preferred embodiments illustrated herein.

SUMMARY OF THE INVENTION

Reference to a roll screen assembly within this specification is to be defined as also including any screen construction which pays out from and returns to a housing whether a roll screen installed with or without a roll tube, or whether the screen is pleated in an accordion like fashion or the like or any other similar screen construction without limitation. When the term screen is utilized its is intended that other matrices such as shades, blinds, and screens whether transparent, opaque, mesh or the like is implied without limitation.

According to a primary aspect of the invention there is provided a sliding screen frame for a closure assembly having an opening and an existing track for mounting a screen, said screen frame comprising framing sections having an outer side edge and an inner side edge, and a screen housing from which a screen is payed out and accumulated, said framing sections being adapted proximate the outer side edge to interfit with a the existing track of the closure assembly to enable the sliding screen frame to slide across the opening of the closure assembly and the frame sections also being adapted proximate the inner side edge thereof to support and guide the free end of the screen between a fully payed out and a fully accumulated position, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

Any framing sections may be joined together by the mitreless corner bracket, each section is cut at substantially ninety degrees proximate each end to interfit with the corner bracket which is preferably generally "L" shaped including legs adapted to engage the adjacent frame sections. The corner bracket may be used to form a mitreless joint for any adjacent frame sections.

Therefore according to yet another aspect of the invention there is provided a mitreless corner connector comprising a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

According to yet another aspect of the invention there is provided a screen frame for a closure assembly having an existing track for mounting a frame, said screen frame comprising framing sections and a housing for paying out and accumulating a screen, said framing sections having an inner and outer side edge, said inner side edge including guides provided therewith, the screen being moveable in said guide of the inner side edge of the framing sections between a fully extended position, whereat the screen is substantially payed out from said housing, and a fully retracted position within the housing; said framing section also being adapted, proximate the outer side edge thereof to engage with the existing track disposed with the closure assembly whether the screen is at the fully extended or the fully retracted position, further comprising either:

(i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a sliding screen frame for a closure assembly having an opening and an existing track for mounting a screen, said screen frame being moveable between a position wherein the screen frame blocks the opening to second position wherein one is able to pass through the opening, said screen frame comprising framing sections having an inner and outer side edge and a screen housing from which a screen is accumulated and payed out, said framing sections being adapted proximate the inner side edge to support and guide the free end of the screen, and the outer side edge being adapted to engage with the existing tracks of the closure assembly, wherein said screen is moveable across the screen frame from an accumulated position within the housing, to a fully payed out extended position, the free end of the screen riding within the inner side edge of the framing section, said screen frame being moveable to and from a position blocking said opening as said outer side edge of the framing section engages the existing track of the closure assembly, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a retainer, (preferably a wind retainer), for installation adjacent the edge of a screen cloth and to guide the motion of said screen cloth in a channel in the track of a screen assembly, said retainer comprising a head part extending away from the edge of said screen cloth and two flange parts extending from said head part at substantially ninety degrees, and capturing there-between the screen cloth which is fastened thereto, said retainer allowing the screen cloth to roll up flat when retracted and does not allow the accumulated screen to go out of round in doing so. Preferably the retainer is heat welded to the screen cloth.

In a preferred embodiment the screen cloth of the screen assembly includes a wind retainer portion proximate the edge thereof for engaging the guide channels within which the free end of the screen is guided, said wind retainer being fastened to the screen cloth and providing a guide part extending outwardly there from for engaging the guide channel. Preferably said guide part is flexible and may be released from the guide channel when subjected to a predetermined force.

According to yet another aspect of the invention there is provided a sliding screen frame for a closure assembly including an opening and having an existing track for mounting a screen, said screen frame comprising framing members connected with a roll out screen housing, said framing members having an inner and an outer side edge and being adapted proximate the outer side edge to allow said screen frame to slide across the closure assembly opening, said framing members also being adapted proximate the inner side edge thereof to support a free end of a roll screen to and from a payed out position, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a screen frame for a closure assembly having an existing track, said screen frame comprising framing sections and a screen housing, each section including, an inner portion adapted as a support and guide for the free end of a screen payed out from said screen housing, and an outer portion adapted to engage with the existing track of the closure assembly whether the screen is at a fully payed out or a fully accumulated position, wherein said screen frame may be installed in the existing track of the closure assembly without the need of tools, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a sliding screen frame comprising frame members including an integral roll out screen housing, said frame members being adapted to allow said frame to slide across a closure frame as well as providing a support for the free end of the roll out screen. In one embodiment said frame includes rollers or wheels preferably located proximate the top and/or bottom of the frame to assist with the sliding motion of the screen frame across the closure frame opening. Preferably the rollers or wheels are included with a support bracket for supporting the roll screen in said housing. In one embodiment the preferred bracket may also include a section to engage the frame member proximate the corners to assemble the members into the screen frame and to house the roller for movement on the track of header and sill of the closure assembly. Preferably the bracket also includes supports within the brackets opposite the rollers or wheels to engage the roll tube of the roll screen. In yet another embodiment the bracket may further comprise a speed control braking system housed within an opening disposed about the roll tube support, wherein centrifugal braking elements are provided and a braking surface such as an "O" ring, preferably said braking elements being retained in position by guides provided with a free wheeling torque tube engaged with the support of the bracket, and with the roll tube. Preferably cut outs are provided as guides for the brake elements in a collar disposed with said torque tube, which guides engage detents disposed with said braking elements.

It is not necessary in all embodiments that the screen frame be slideable within conventional constructions such as channels, tracks, and the like. The essence of the invention is therefore that the screen frame includes framing sections and a screen housing, and that each section includes an inner portion adapted to be used as a guide for the free end of the screen and an outer portion adapted to engage with and in one embodiment slide in the preferred existing channel, track or hardware disposed with closure assembly whether the screen is at the fully extended or the fully retracted position.

The invention therefore also includes a frame member for a screen frame including a housing from which a screen is payed out and accumulated, said member comprising a first portion adapted for engagement with, preferably conventional existing, window and door frame hardware, channels, tracks and the like; and a second portion adapted to guide the free end of the screen, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

Therefore, to these ends according to another aspect of the invention, there is provided a kit of components for a screen frame comprising framing members, a screen housing, and a screen contained in and payed out from said housing, said framing members being firstly adapted engage with, preferably conventional existing, window and door frame hardware, channels, tracks and the like; and also being adapted to guide the free end of the screen. The first adaptation of the frame members is to provide engagement of the screen frame of the present invention with known constructions which presently engage known screens for doors, windows and patio doors, 1) such as a typical rail used with patio doors which includes a rail or the like which engages a sliding mechanism, usually a roller; or 2) such as a typical lift out screen arrangement for windows including a generally u-shaped flange for acceptance of a screen frame; or 3) such as a typical casement screen channel with engagement pins which are rotated out of position to allow screen removal; wherein the present invention is unlike the prior art constructions not permanently attached which can be readily replaced and attached by a home owner. Therefore a kit of components may be provided which includes the framing sections and the housing and roll screen which may be assembled to provide the above-mentioned screen frame. Of course the screen frame may also slide which has been described above. This however, is not absolutely necessary. The need that is being satisfied is that the present invention allows for replacement of existing screens using the same channels, rails and/or hardware provided for existing assemblies wherein the present invention is adapted to fit those channels, rails and/or hardware allowing the home owner the ease of installation without providing the requirement of an expensive installer and retro fitted parts.

In yet another embodiment there is provided kit of components for assembly of a screen frame comprising framing sections, a screen housing, and a screen accumulated and payed out from said housing, said framing sections being adapted to engage existing tracks of a closure assembly and also being adapted to guide and support the free end of the screen as it is payed out and accumulated from said screen housing, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

In another embodiment there is provided a screen frame construction for a closure assembly comprising framing sections having an inner and outer side edge, and a screen housing from which a screen is payed out and accumulated, said frame sections being adapted proximate the outer side edge to interfit with existing tracks of the closure assembly, and said framing sections being adapted proximate the inner side edge to support and guide a screen as it is payed out from the housing, further comprising either (i) a mitreless corner connector having a generally "L" shaped member including two perpendicular legs extending from a central box shaped part, said connector for connecting adjacent framing sections without the need for mitre cuts thereof and said box shaped part for butting with the adjacent framing sections when joined to said connector to establish continuity with the adjacent edges of said sections.

or (ii) a speed control braking assembly, for a rotating hollow shaft for accommodating said screen, and to impede rotation of said shaft at a predetermined speed, said assembly having a centrifugal braking element, a bracket containing said element coupled to said shaft, a friction member disposed with said bracket, a freewheeling torque tube coupled to said bracket and said shaft for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a support bracket for a roll screen which comprises a support for said roll screen proximate one end of the bracket and an integral mounting part for a roller or wheel proximate the other end of the bracket. In another embodiment of the invention there is provided a support bracket for a roll screen having two ends comprising a support for said roll screen proximate one end of the bracket and also including a section to engage the framing members proximate the corners of the screen frame to assemble the members into the screen frame, further comprising a speed control braking assembly, for a rotating hollow shaft for accommodating said roll screen, and to impede rotation of said shaft at a predetermined speed, said assembly having a centrifugal braking element, the bracket containing said element and being coupled to said shaft proximate said support, a friction member disposed with said bracket, a freewheeling torque tube coupled to said bracket proximate said support and to said shaft remote said support, said tube for controlling motion of said braking element, wherein at low speed there is effectively no resistance to rotation of the shaft but at a predetermined speed the shaft speed is controlled when the braking element is moved by centrifugal force to engage said friction part to thereby inhibit motion of said shaft.

Preferably the bracket may be made from nylon, plastic, Delrin® or the like.

In yet another embodiment the bracket may further comprise a speed control braking system housed within an opening disposed about the roll tube support wherein centrifugal braking elements are provided and a braking surface such as an "O" ring, preferably said braking elements being retained in position by guides provided with a free wheeling torque tube engaged with the support of the bracket, and with the roll tube. Preferably cut outs are provided as guides for the brake elements in a collar disposed with said torque tube, which guides engage detents disposed with said braking elements.

In still yet another embodiment there is provided a speed control braking assembly for a rotating hollow shaft to impede rotation of said shaft at a predetermined speed, said assembly comprising a centrifugal braking element, a housing for said element coupled to said shaft, a friction member disposed in said housing, a freewheeling torque tube coupled to said housing and said shaft for controlling motion of said braking elements, wherein at low speed there is effectively no resistance to rotation of the shaft but at a predetermined speed the shaft speed is controlled when the braking element is moved by centrifugal force to engage said friction part to thereby inhibit motion of said shaft.

According to yet another aspect of the invention there is provided a sliding screen frame for a closure assembly having an opening and an existing track for mounting a screen, said screen frame comprising header, sill and two jamb framing sections, said framing sections being connected to one another to form a frame by the use of a mitreless corner connector, said framing sections having an outer side edge and an inner side edge, and a screen housing from which a screen is payed out and accumulated, said framing sections being adapted promixate the outer side edge to interfit with the existing track of the closure assembly to enable the sliding screen frame to slide across the opening of the closure assembly and the frame sections also being adapted proximate the inner said edge thereof to support and guide the free end of the screen between a fully payed out and a fully accumulated position, said mitreless corner connectors comprising a first detent for connecting to adjacent framing sections (preferably a first leg) and a second detent for connecting to the other adjacent framing section (preferably a second leg) said two detents being sufficiently spaced from one another to obviate the need for a miter joint when joining said framing sections. In a preferred embodiment the screen cloth of the screen assembly includes a wind retainer portion proximate the edge thereof for engaging the guide channels within which the free end of the screen is guided, said wind retainer being fastened to the screen cloth and providing a guide part extending outwardly there from for engaging the guide channel. Preferably said guide part is flexible and may be released from the guide channel when subjected to a predetermined force.

Preferably the screen assembly includes a centrifugal braking system for impeding the uncontrolled retraction for the roll screen preferably, comprising a speed control braking system housed within an opening disposed about the roll tube support wherein centrifugal braking elements are provided and a braking surface such as an "O" ring, preferably said braking elements being retained in position by guides provided with a free wheeling torque tube engaged with the support of the bracket, and with the roll tube. Preferably cut outs are provided as guides for the brake elements in a collar disposed with said torque tube, which guides engage detents disposed with said braking elements.

Preferably there is provided a torque tube for fastening to a hollow shaft proximate one end and for engaging a support bracket for the hollow shaft at the other, wherein the torque tube is free wheeling on said support bracket, said tube having a substantially "Z" shaped flange to interconnect the part for engaging the hollow shaft with the part engaging the support bracket, wherein said "Z" shaped flange permits flexing of the torque tube to accommodate a predetermined variation in the hollow of said hollow shaft and wherein the torque tube tightens if efforts are made to separate the shaft and the torque tube (preferably providing for 0.010 inch variation in the hollow shaft dimension.)

The framing members may be formed from nylon, plastic, steel, aluminum, fiberglass, PVC or the like by any conventional method including roll forming, pultrusion, extrusion, CNC fabrication, with no limitation being implied whatsoever.

In yet another aspect of the invention, the flexible wind retainer previously described does not interfere with the retraction of the screen, said wind retainer including a guide part and having extending there from and perpendicular thereto, two thin flanges which capture the screen cloth and which are secured to said cloth by welding by heat, ultra sound, or the like; said thin flanges being sufficiently thin so as not to prevent the smooth retraction of the screen cloth on the roll tube or to impede the paying out thereof. Preferably the wind retainer is positioned at intervals along each edge of the screen cloth so as to provide further guides of the screen with the handle part. In this way the screen cloth will not go out of round, and will roll up flat when accumulated on the screen tube.

When the term conventional and or existing hardware, channels, tracks or the like is used in this specification with reference to the various aspects of the invention described above it is implied that such hardware, channels, and tracks are utilized to secure existing planar screens found in windows, doors, patio doors and other closure assemblies whether existing, replacement or original assemblies such as but not limited to tilt and slide windows, casement windows, double hung windows, awning windows, pivoting doors, and patio doors. Further it is intended that the screen assembly of the various embodiments of the invention may be easily and simply placed or dropped into position with a minimum of effort without requiring fastening in position with the exception of rotating or retracting a holding pin or the like or making a tension adjustment to the roller. Conventionally hardware channels and/or tracks or the like are located with the various assemblies discussed above to allow this simple installation. The homeowner can therefore use conventional existing hardware for installation of the various embodiments of the present invention or alternatively if desired can provide replacement hardware which may be of any compatible shape or configuration or which may engage the conventional hardware or alternatively may replace it. Simplicity of replacement or installation is the key for our screen assembly.

DETAILED DESCRIPTION OF THE INVENTION

Although the following description focuses on a patio door screen, it is not intended that the invention be limited in this aspect. The invention also may be embodied with other doors, windows, or the like. Those skilled in the art will recognize these other uses without limitation.

Figure 2:
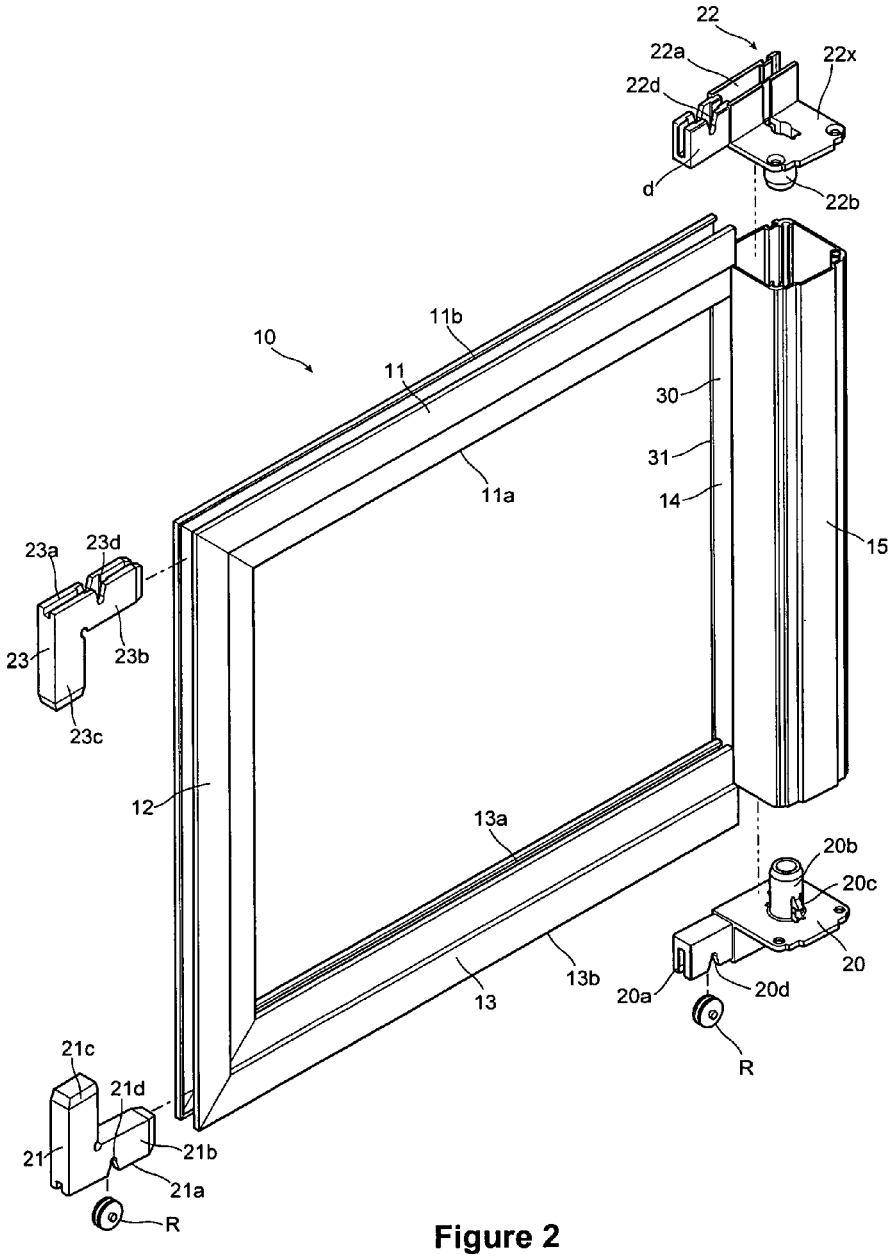
FIGS. 2 and 2A are exploded perspective views of the frame section of FIGS. 1 and 1A.
Figure 2A:
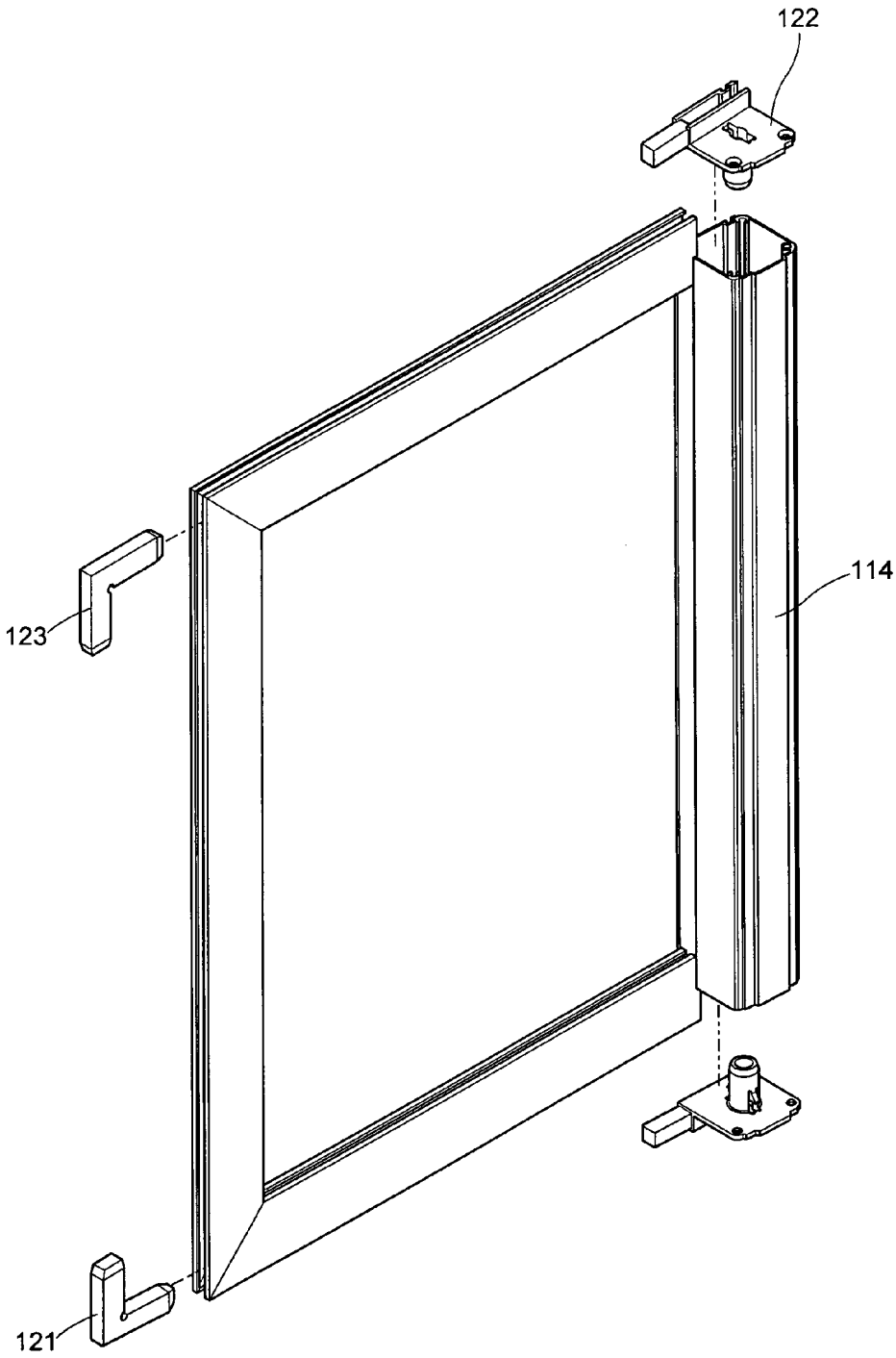

Referring generally to the figures, there is illustrated a screen frame assembly (10) which includes a screen housing (14) and frame sections (11, 12, and 13) making up the frame (10). The assembly (10) slides within an opening of a closure assembly such as a patio door. The sliding action of the screen frame (10) is accomplished by sliding the screen frame along the edges (11*b* and 13*b*) within tracks or channels normally found within a patio door assembly. These channels are found in the sill and the header of the door assembly. The screen frame (10) therefore moves as is known in prior art sliding constructions. However, integral with the framing section (10) is a compartment (15) within which is found a spring biased roll screen assembly. As best seen in FIG. 2, the leading edge (31) of the screen (30) travels within the inside edges (13*a* and 11*a*) of the frame portions (11 and 13) to and from a fully accumulated position wherein the screen is accumulated on the roll tube which will be described hereinafter, to a fully extended position wherein the leading edge (31) is located proximate the channel portion (12*a*) adjacent the interior of section (12) which screen edge (31) may be latched and/or locked in position. Whether the screen (30) is at the fully accumulated or the fully extended position, the entire screen assembly (10) may be slid across the patio door opening. In this manner, the screen is slid out of a position where it might block the threshold to an occupant. This allows passage of wheel chairs, walkers and the like in a simple manner and overcomes one of the problems in the art.

Figure 3:
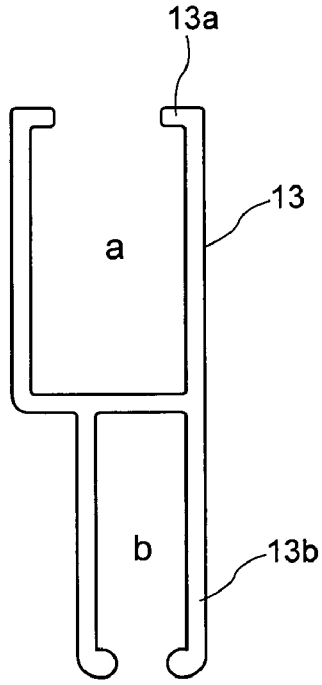
FIGS. 3 and 3A are cross sectional views of the frame section 13 and 113 of FIGS. 1 and 1A illustrated in preferred embodiments of the invention.
Figure 4:
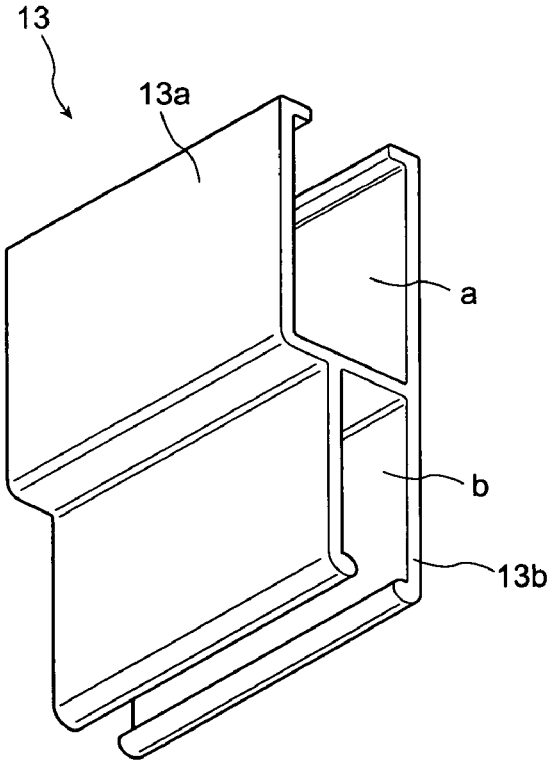
FIGS. 4 and 4A are perspective views of the sections of FIGS. 3 and 3A.
Figure 3A:
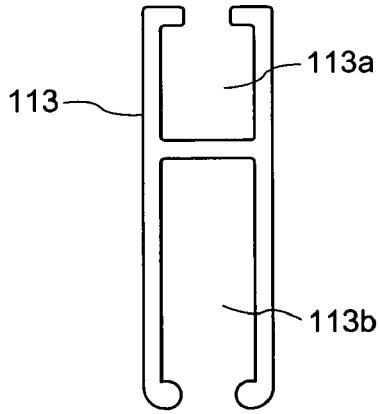
Figure 4A:
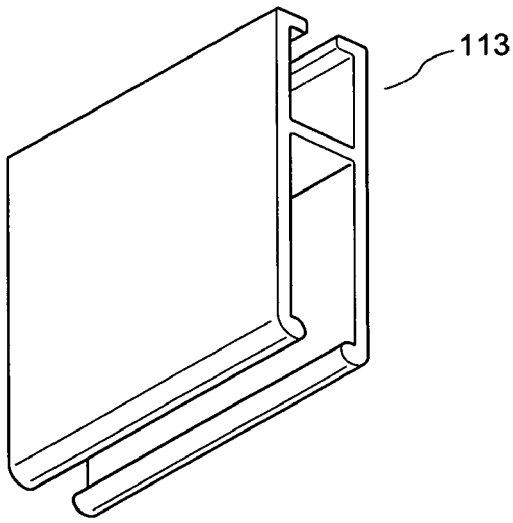
Figure 5:
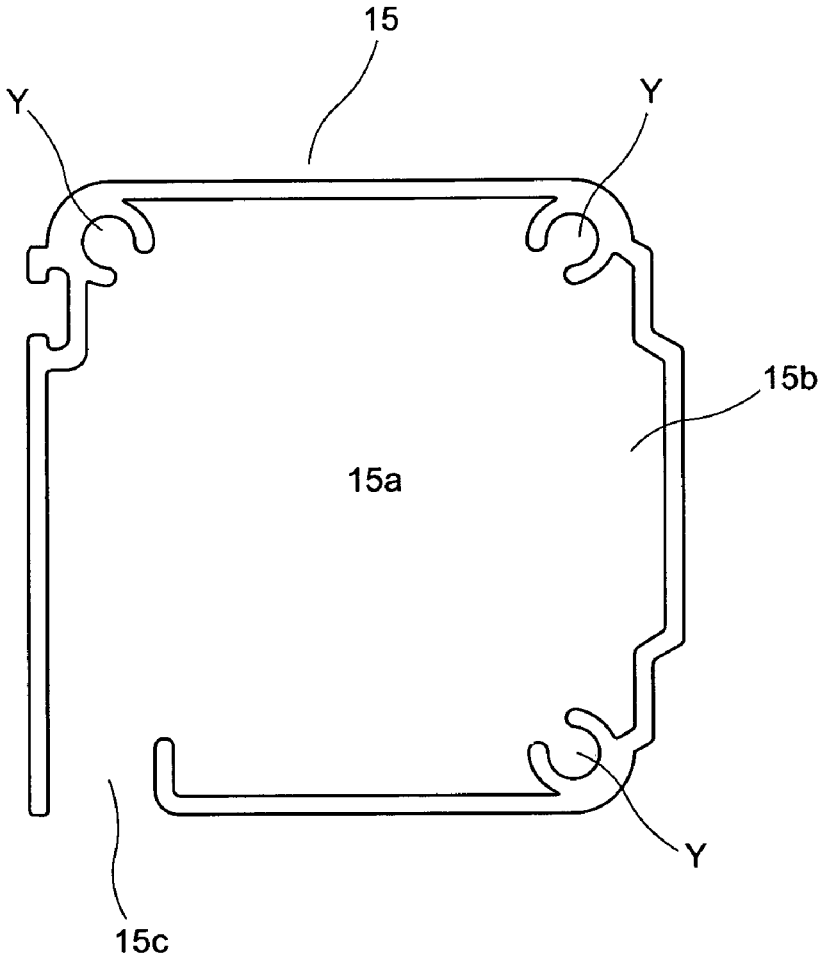
FIG. 5 is a cross sectional view of the cover portion (14) illustrated in FIGS. 1 and 1A.
Figure 6:
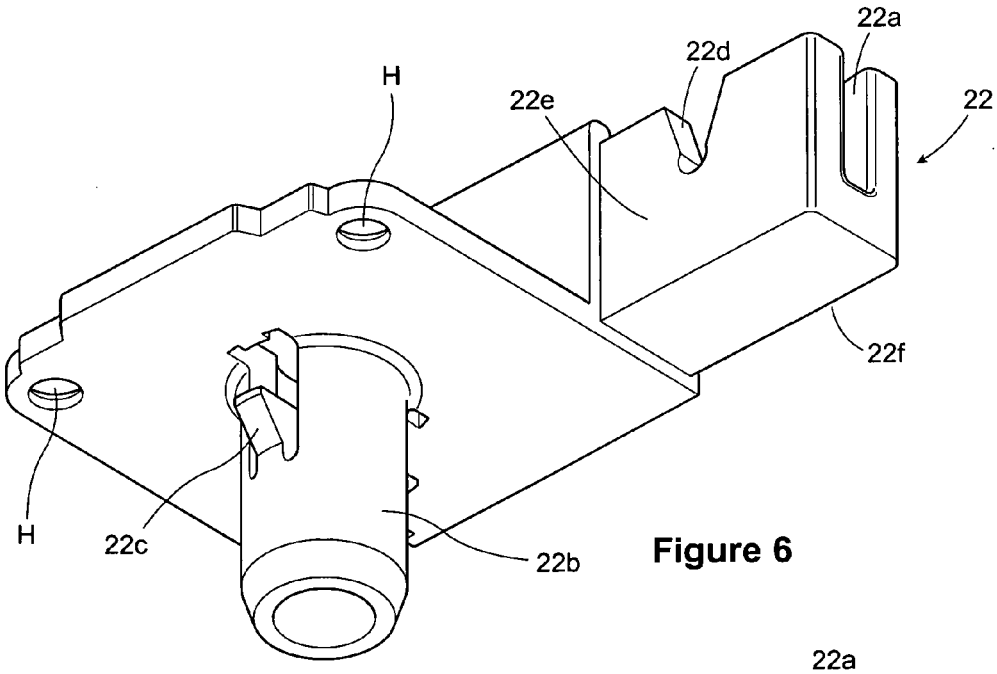
FIGS. 6, 7, 8 and 9 and 6A, 7A, 8A, and 9A are top and bottom front and rear perspective views of the bracket portions (22) and (122) as seen in FIGS. 2 and 2A and illustrated in preferred embodiments of the invention.
Figure 7:
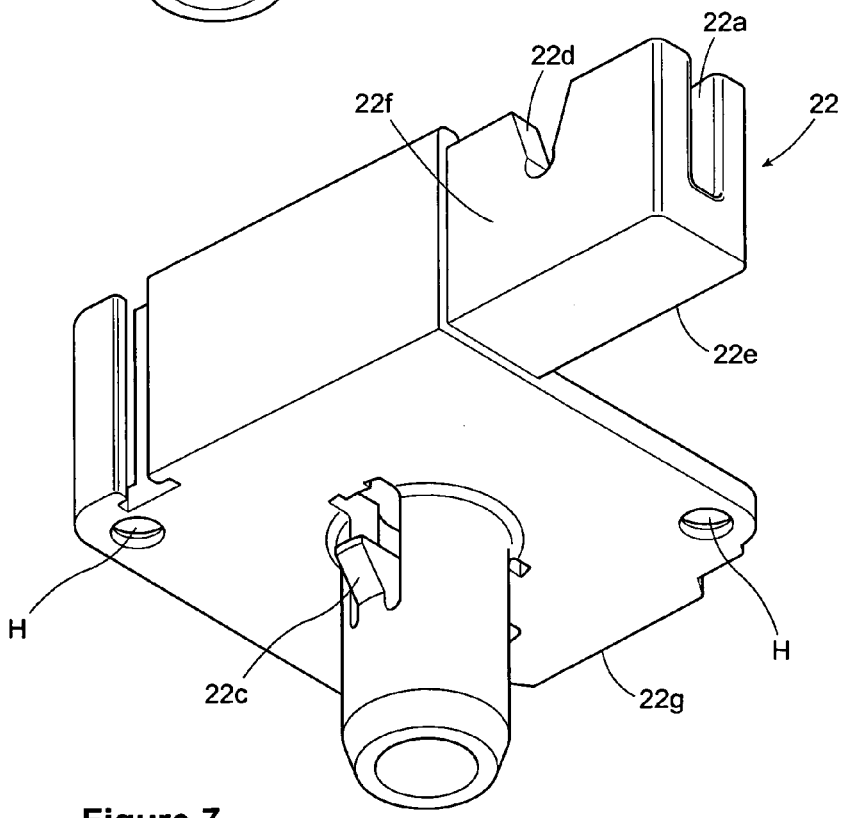
Figure 6A:
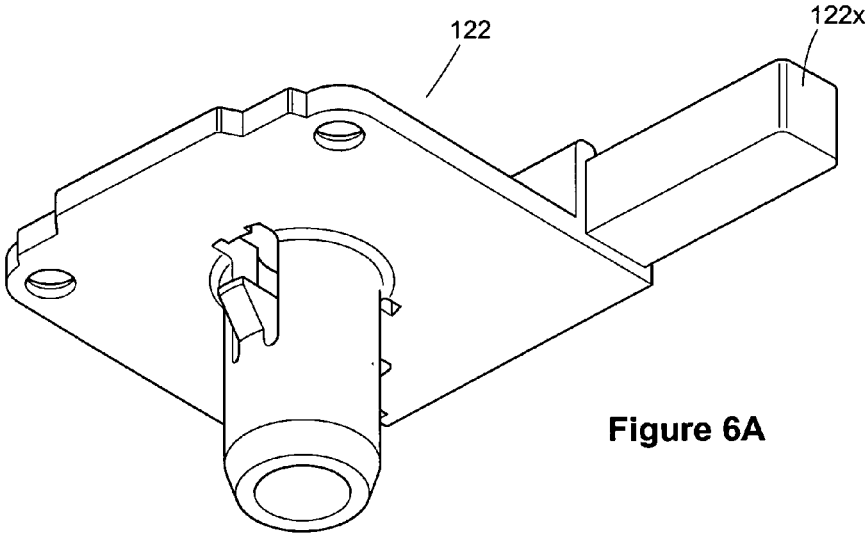
Figure 7A:
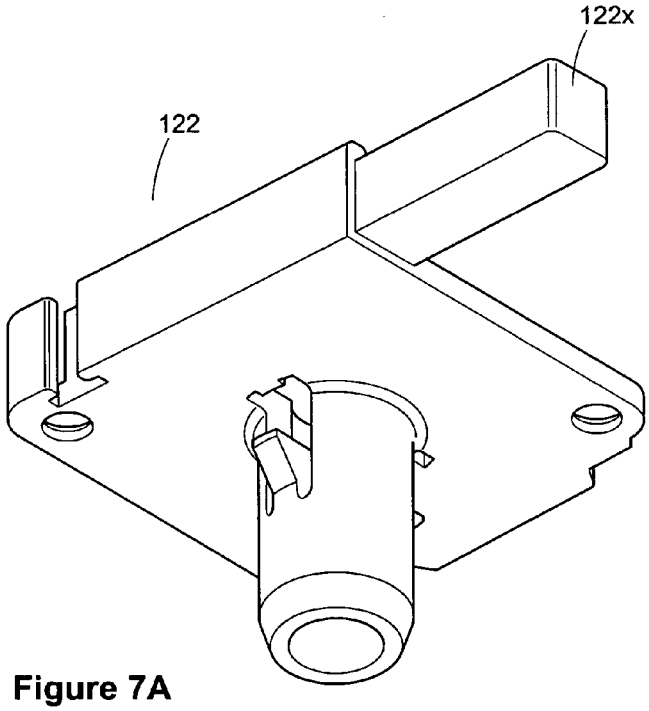
Figure 8:
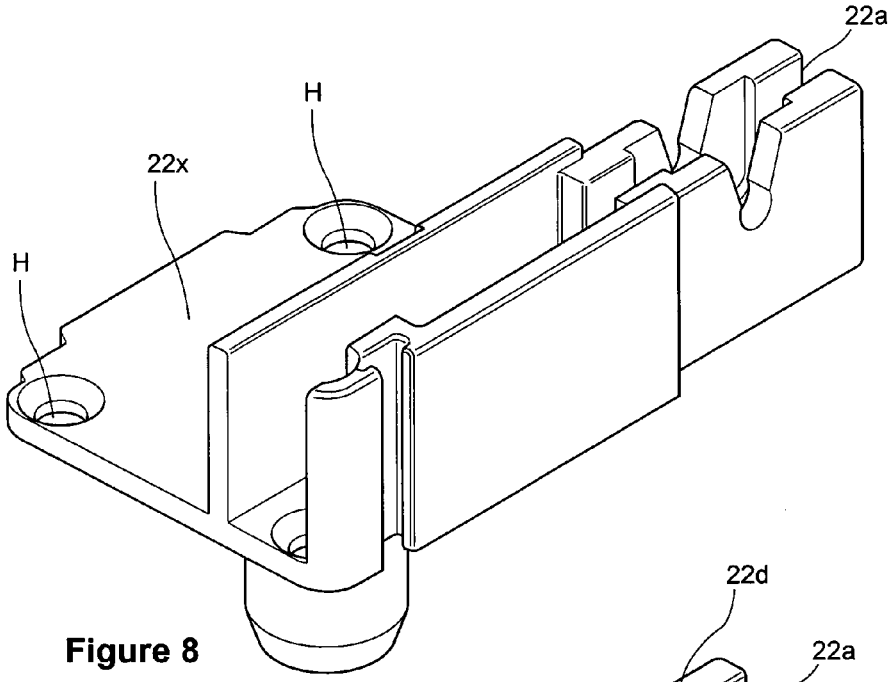
Figure 9:
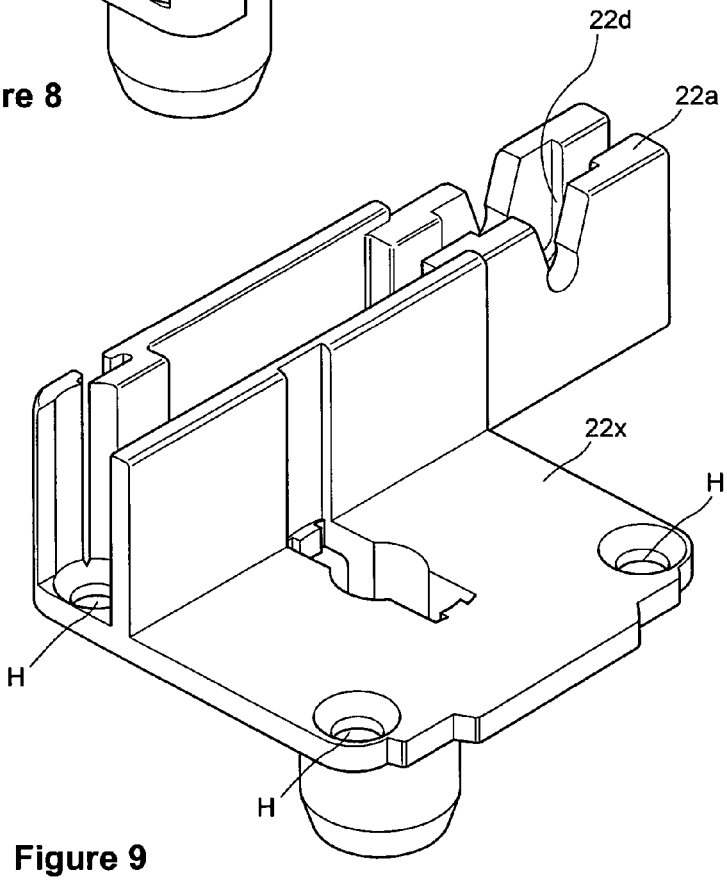
Figure 8A:
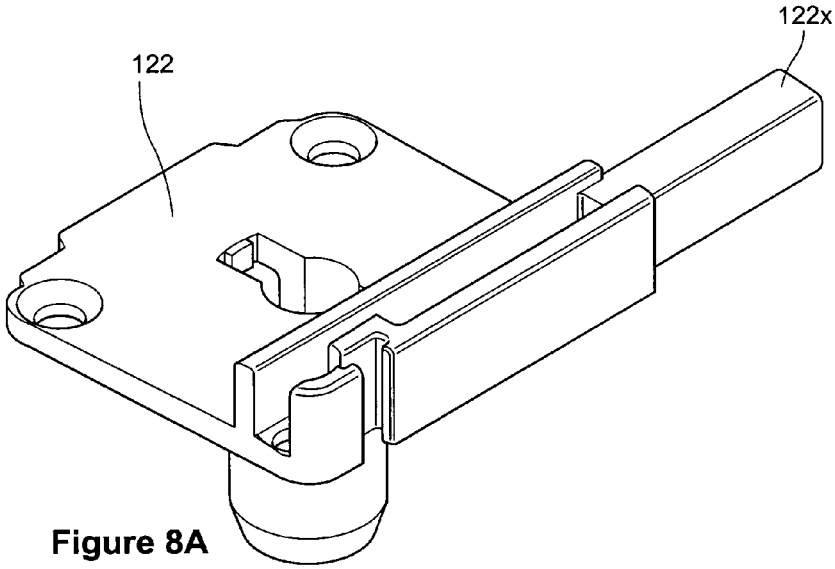
Figure 9A:
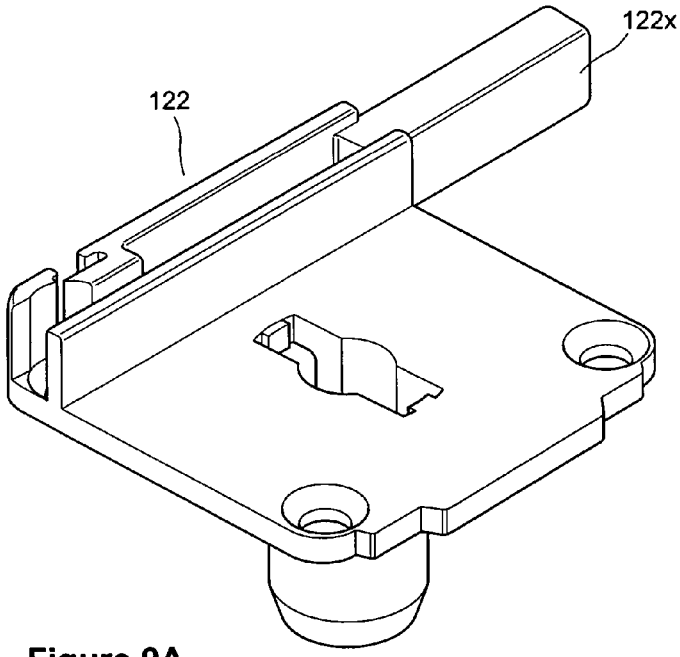
Figure 10:
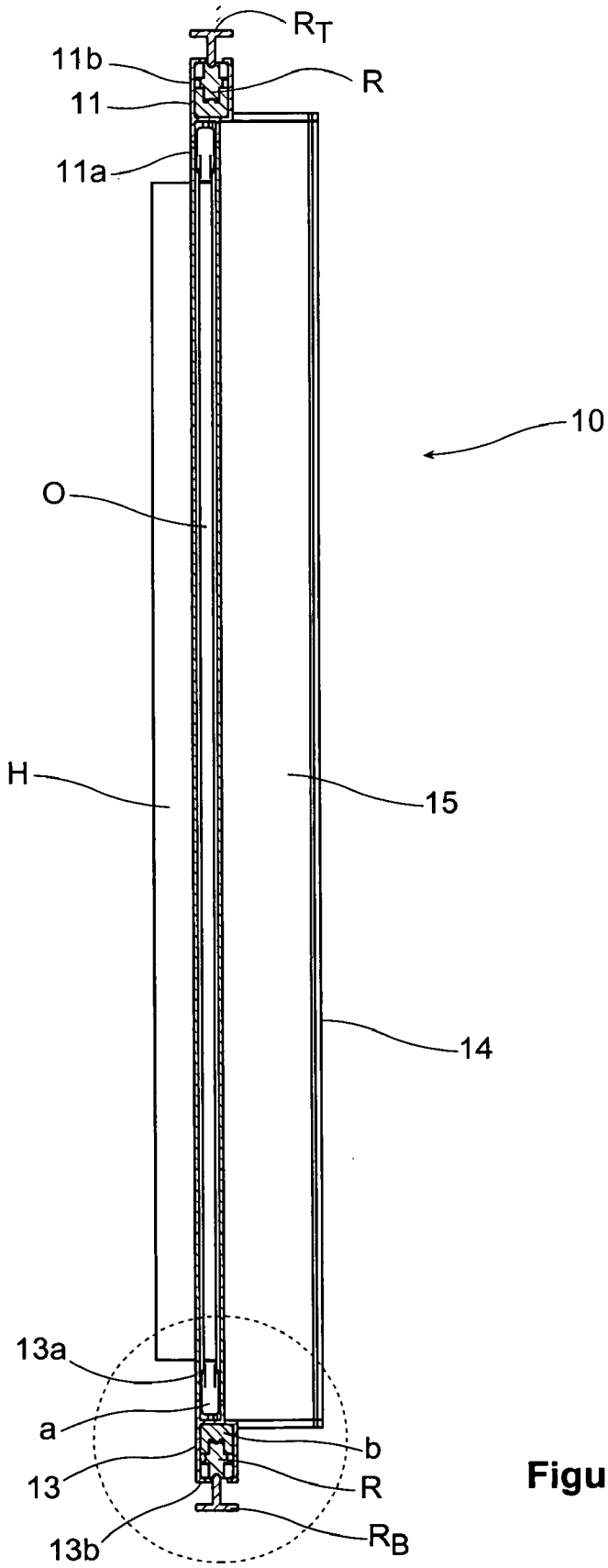
FIGS. 10 and 10B are cross sectional views of the screen assembly of FIGS. 1 and 1A providing details with respect to the operation thereof and illustrated in preferred embodiments of the invention.
Figure 10A:
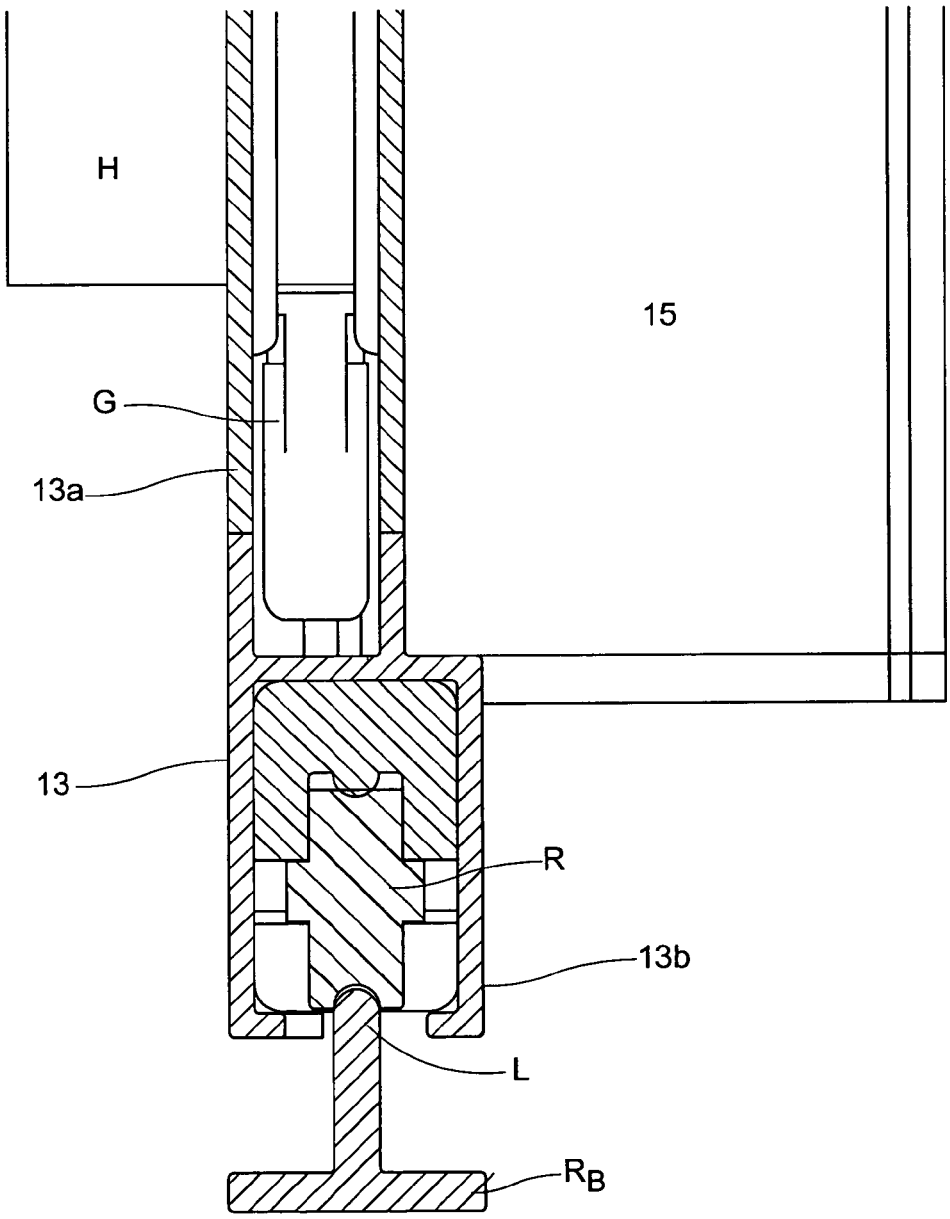
FIGS. 10A and 10C are close up cross sectional views of the bottom end of FIGS. 10 and 10B indicating the details thereof.
Figure 10B:
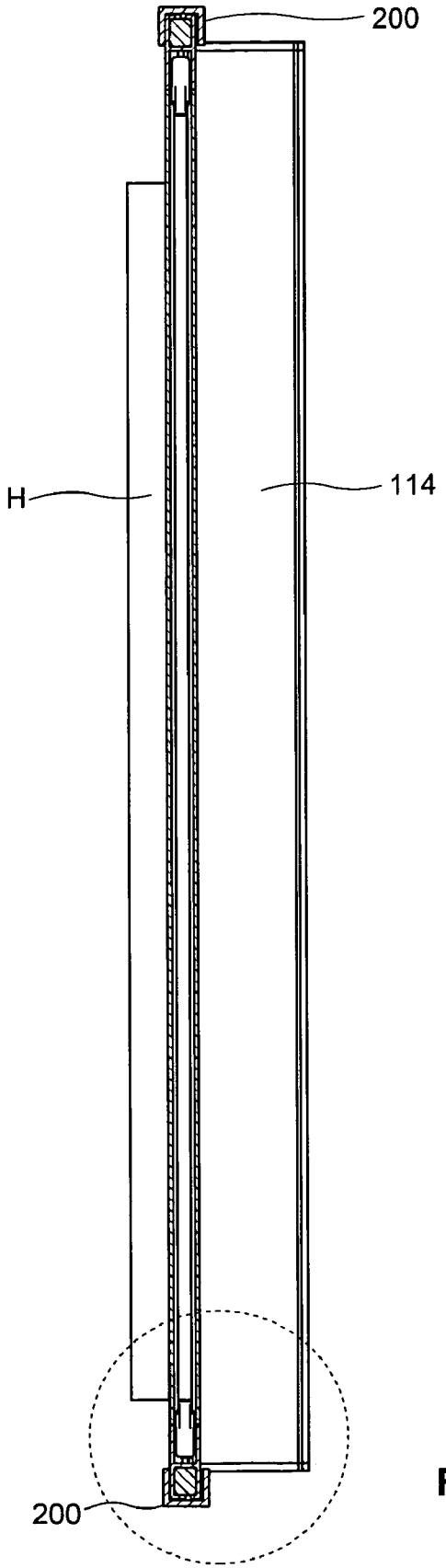
Figure 10C:
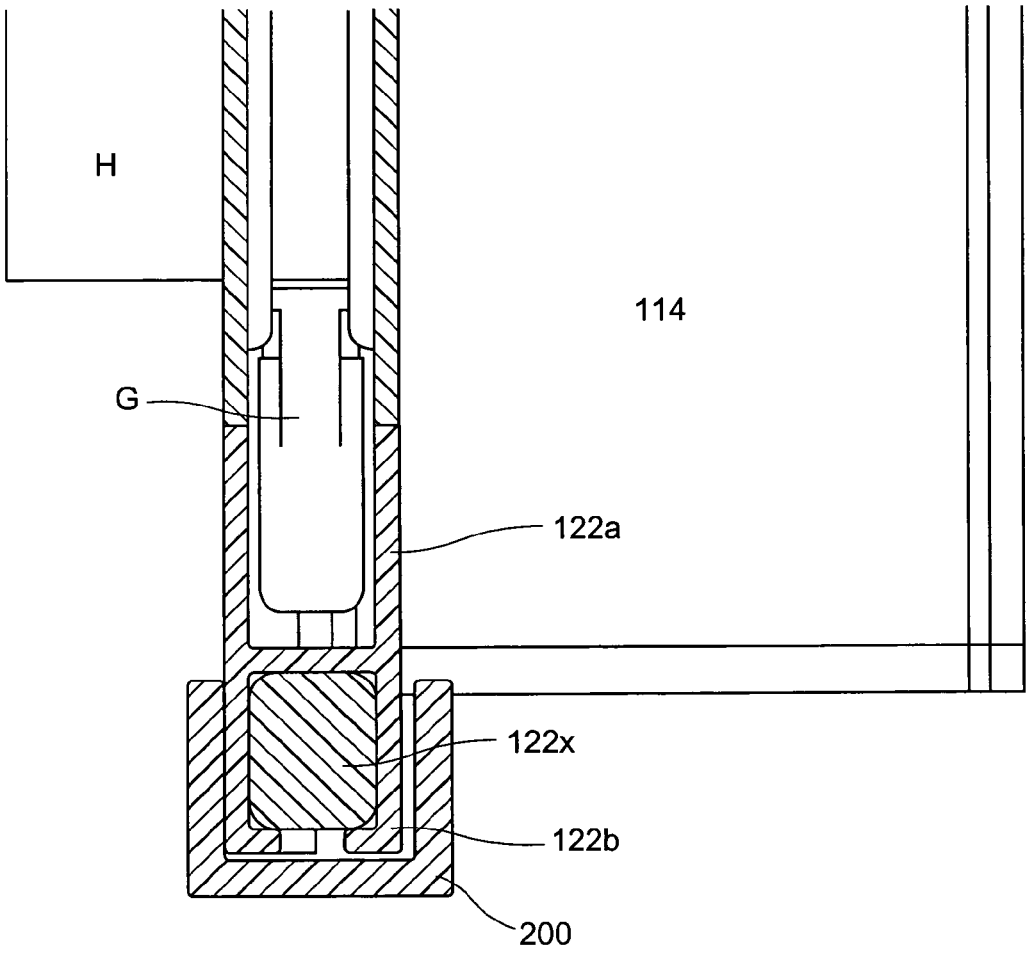

As best seen in FIGS. 3 and 4 the portion (13*b*) of section (13) has opening (b) therein to be received in standard sized channels or rails provided in the sill and header frames of the track assembly. The leading edge of the screen (31) will slide or be guided via guide (G) within the section (13*a*) within channel (a) thereof as described above and hereinafter to assist motion of the leading edge (31) of the screen (30).

Figure 14:
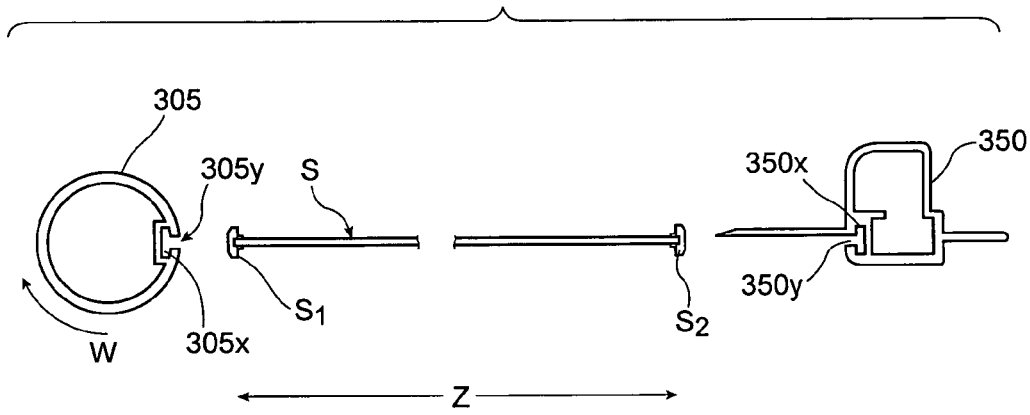
FIG. 14 is a schematic view indicating the manner in which the screen is attached to the handle and the tube illustrated in one embodiment of the invention.

Rollers (R) may be provided with the brackets (21 and 20) at mounting slots (20*d*) and (21*d*) which rollers travel within the sill track. They also may be provided for brackets (22) and (23) for the header. The bracket portions (20, 21, 22 and 23) also provide channel portions (20*a*, 21*a*, 22*a* and 23*a*) which marry within the track portions of the closure assembly and which assist with the assembly of the screen frame 10. As seen in FIG. 11*a* leg portions (d) and (f) for brackets (20 and 22) and (21 and 23) respectively interfit in channels (b), (d') and (b') respectively to assemble the frame sections (11, 12 and 13) with the housing (14). The brackets also provide extensions for example, track portion (13*b*) and providing a channel (b) to receive the track disposed within the sill and header of the rails normally provided. The roller (R) therefore is spring biased as is known to accommodate various tensions. Release pins may be provided, as is known, within the legs of brackets (21 and 23) to allow installation and replacement of the screen frame in a similar manner as conventional planer screen frames, which are known in the art. The brackets (22 and 20) support the roll screen assembly (S) therebetween mounted on a tube. The tube has a slot in it to receive one end of the screen with the other end of the screen being proximate the exit from the tube housing (15) as best seen in FIG. 14 at (15*c*). The brackets (20 and 22) as best seen in FIGS. 6, 7, 8 and 9 have holes therein for aligning with holes (y) within the housing (14) to align the portion (22*z*) with portion (15*b*) and receipt of threaded screws. The mouth (15*c*) therefore of the cover (15) allows for the free end (31) of the screen assembly (30) to extend therefrom. Locking portions (22*c*) provide locking of the roller tube in position.

When fully assembled the screen assembly (10) therefore can replace an existing sliding screen utilizing the same channels of the existing patio door. This enables the homeowner to effect the replacement without the need for an experienced installer or add on supplementary components. No assembling is required. The screen assembly 10 merely drops into the existing channels.

As can be seen from the Figures, the present invention resembles the well-known prior art sliding patio door screen in that it may be slid from a position where it fully covers the door opening to a position where it does not. However, it clearly has the added advantage in that the screen may be accumulated on the roller when the entire frame is at the first position so that it does not block the view of the occupants when the patio door is in fact closed. However, when the patio door is open, the roll screen may be extended to the fully extended position and latched thereat so as to prevent insects from entering the dwelling. However, when an occupant wishes to exit the dwelling, the patio screen assembly (10) may be slid in a conventional manner so as to not obstruct the threshold as is the case with prior art structures discussed in the background of the invention. The framing sections (11, 12, 13 and 14) may be made from aluminum extrusions or the like, and the brackets (20, 21, 22 and 23) may be manufactured from nylon or other resins. Section 14 may be an aluminum extrusion as well.

The entire assembly may be provided in a kit of components wherein all of the framing sections (10, 11, 12, 13 and 14), brackets (20, 21, 22 and 23) housing (14) and the roller screen assembly may be provided in the kit which may be easily assembled. When compared to the prior art constructions of PHANTOM™ or MIRAGE™, instead of the typical 22 steps in order to provide such a prior art construction which typically is done by an expensive installer, the present roll out screen will be marketed for substantially the same price as the well-known standard sliding planer screens in various consumer outlets and may be used to replace standard screens when they are in need of repair.

Further Applicants may utilize the flexible screen connectors of FIG. 14 in the screen assembly (10) as taught in its prior patent technology referenced above, using a roll tube having a compatible detent therein and handle portion having compatible detent therein for receiving the flexible T-shaped connector at each end of a screen cloth which may therefore may accommodate easy screen replacement. It is required that the same dimensions (length, width and thickness) be utilized for the threshold and header track engaging framing portions (11 and 13) as those which are standard at the present date. This will allow for easy replacement of the conventional planer screen with the present invention. As is taught in Applicant's prior invention the tube may be tensioned by the means as disclosed therein.

Figure 1:
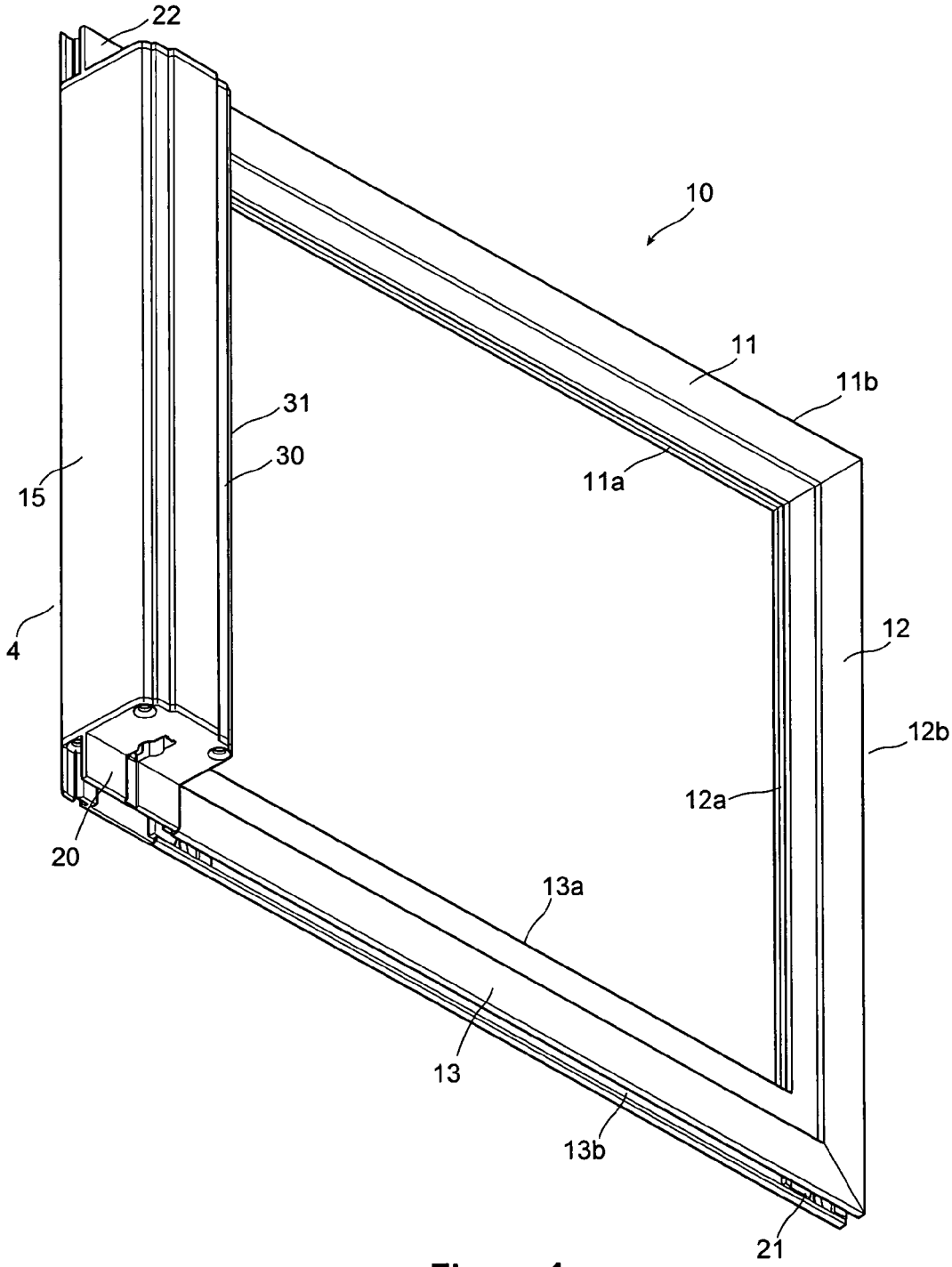
FIG. 1 is a perspective view of the frame section in a patio door illustrated in a preferred embodiment of the invention.
Figure 1A:
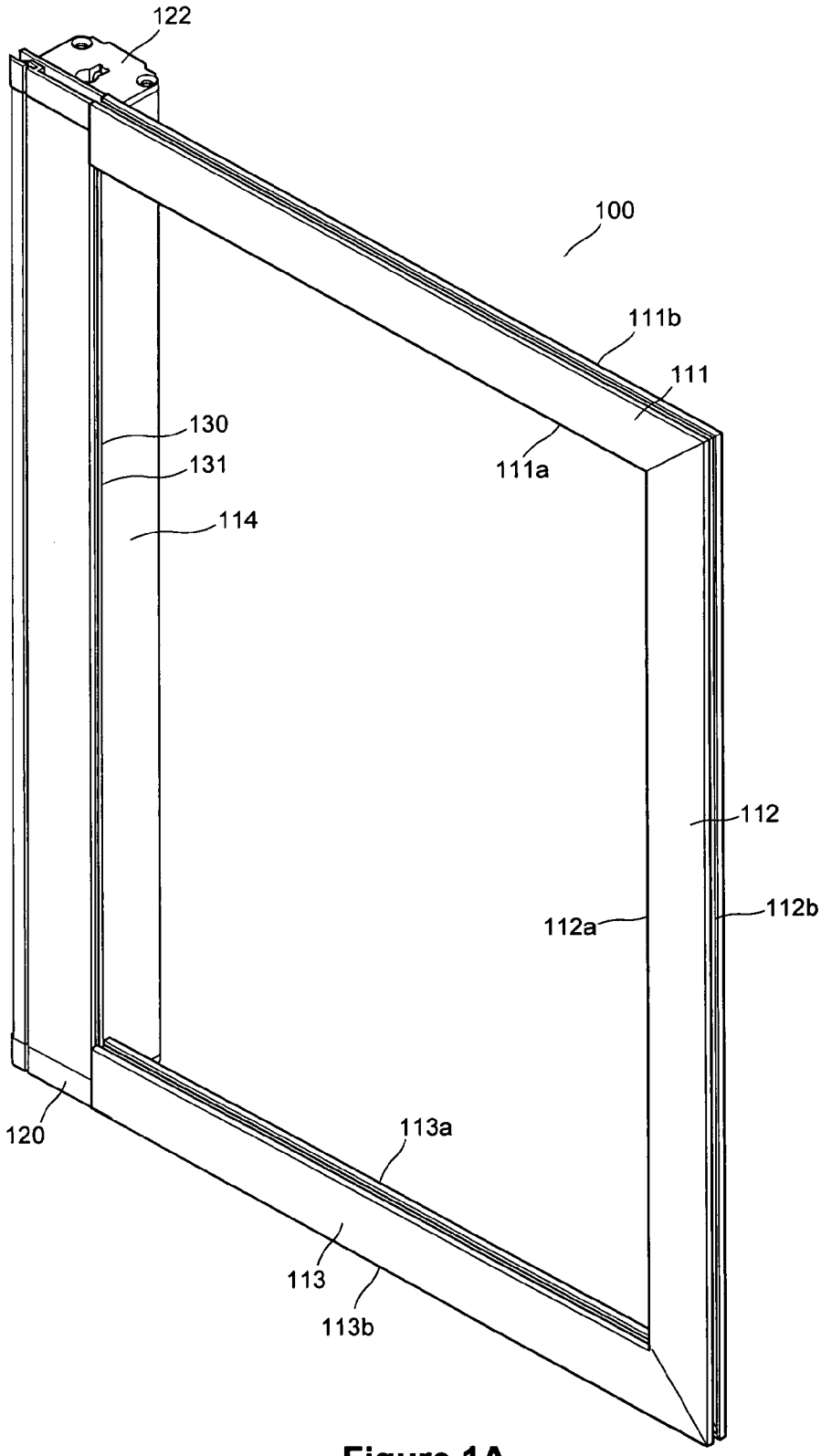
FIG. 1A is a similar view to that of FIG. 1 for a window assembly.
Figure 11:
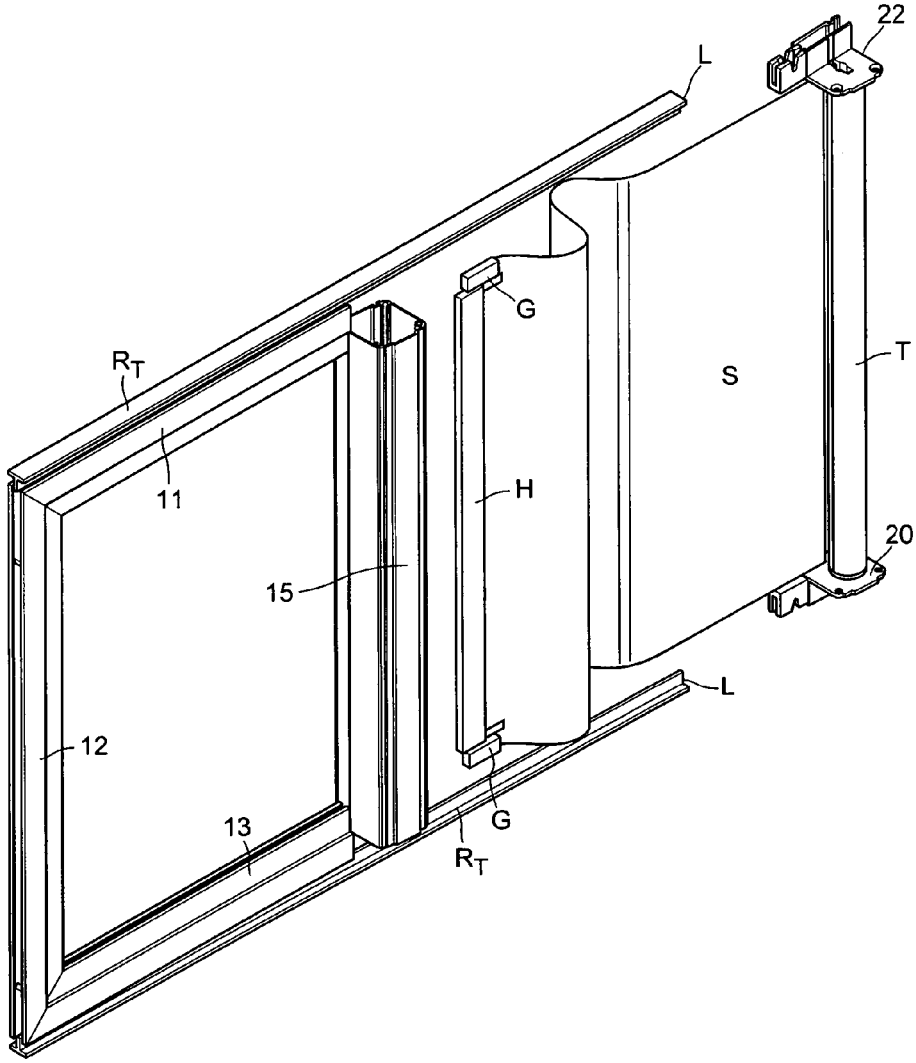
FIGS. 11 and 11D are partially exploded schematic views of the assembly of FIGS. 1 and 1A illustrated in preferred embodiment of the invention.
Figure 11A:
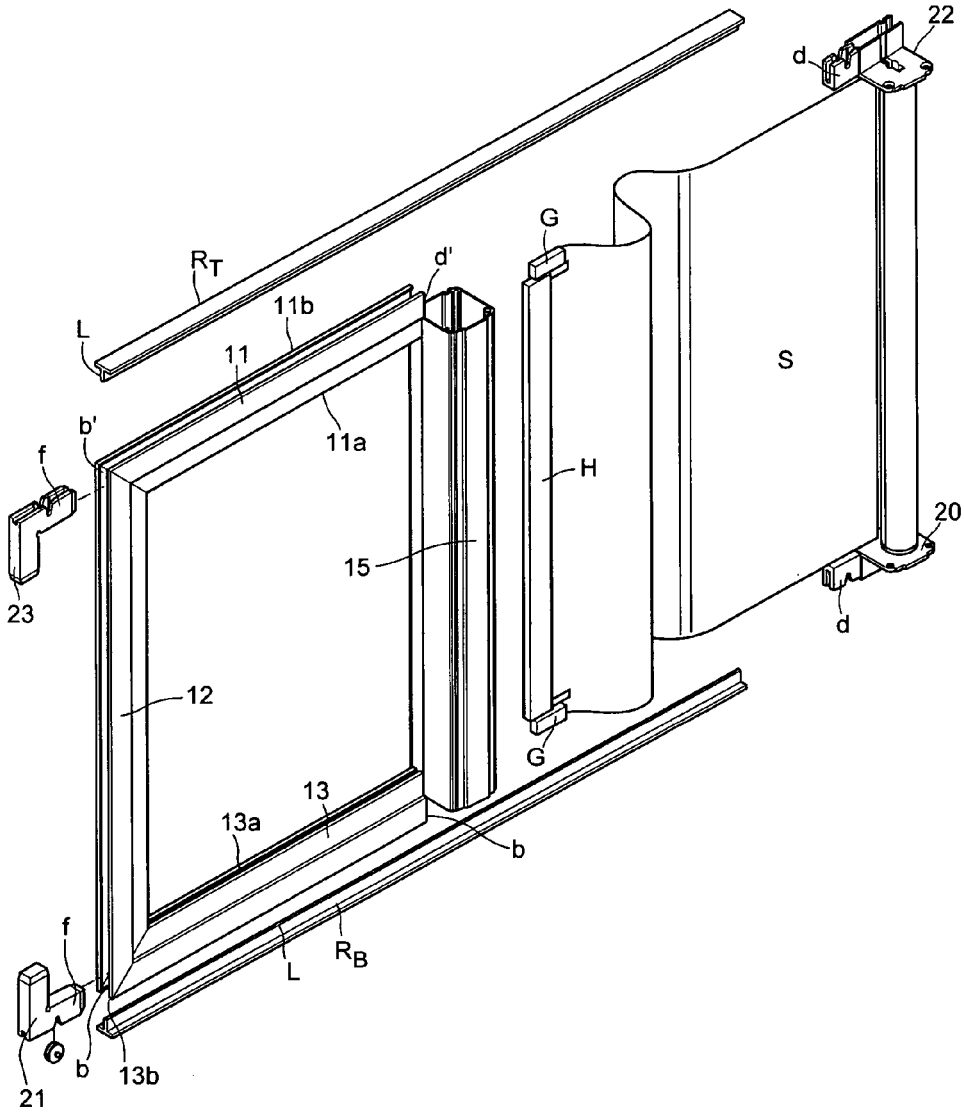
FIG. 11A is a further exploded schematic view of FIG. 1.
Figure 11B:
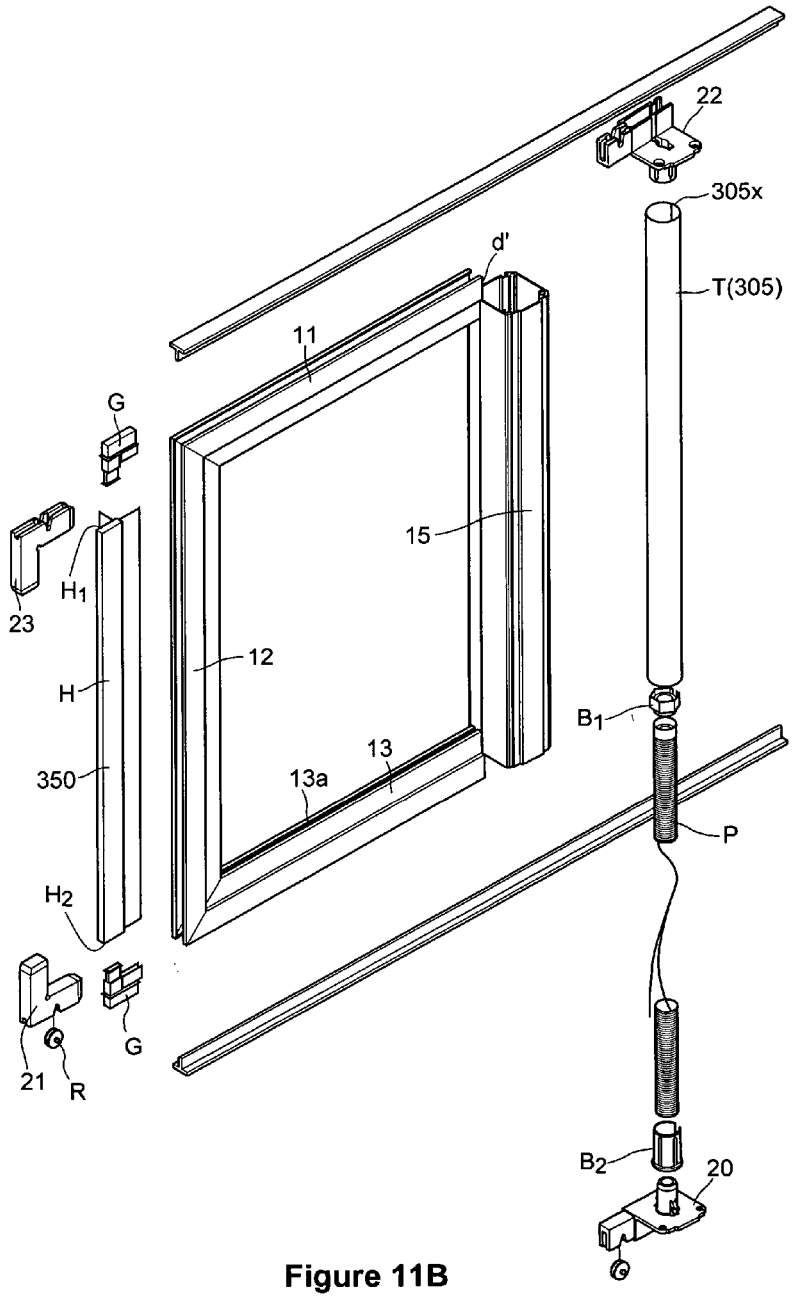
FIGS. 11B and 11E are substantially totally exploded schematic views of the assembly of FIGS. 1 and 1A.

Referring now to FIGS. 10, 10*a*, 11, 11*a*, 11*b*, and 14 there is illustrated the assembly (10) of FIG. 1 engaging top rail (RT) bottom rail (RB) proximate the top thereof (L). Conveniently therefore the sections (11) and (13) are provided having openings or channel sections as best seen in FIGS. 3 and 4 at (11*a*) and (11*b*) and (13*a*) and (13*b*) which as best seen in FIG. 11 defining the top and bottom sections of the screen assembly (10) which now includes the housing for the roll out screen (S) and the frame sections (11) and (13) which includes an upper and a lower section or profile (11*a*) and (11*b*), (13*a*) and (13*b*) respectively. The inside portions (11*a*) and (13*a*) are for the receipt of the legs (d) and (f) of the brackets (20, 21, 22 and 23) to close the frame sections and integrate the entire assembly by attaching the housing and roll screen thereto. Clearly, as can best be seen in FIG. 10A the roller (R) engages the rail (RB) proximate the top thereof (L) in a conventional manner, said roller being provided with the brackets (21 and 20) and preferably (23 and 22) as previously described in relation to FIG. 2. The patio screen assembly (10) will therefore be free to roll upon the rails (T, R and B) in a conventional manner. However, the sections (11 and 13) also include sections (13*a*and 11*a*) for receipt of and the carriage of the guide (G) for the handle (H) of the screen assembly accumulated on the tube (T) advanced via handle (H) to the guides (11*a* and 13*a*) to proximate the section opening of (12*a*) where at the handle may be latched. The latch is not illustrated nor described and would be as is known. The brackets therefore in combination with the framing sections (11, 12, and 13) provide, along with housing (14), an integrated screen frame which will slide along the known rails in a patio door closure assembly with the guides (G) attached to handle (H) via the legs which extend upwardly and downwardly into the opening provided in the handle with the handle being engaged with the T section shown in FIG. 14 at (S2) attached to the screen and the handle at (305*y*) and to the tube at (305*x*) via T section (S1). As seen in FIG. 11*b* the tube is attached to bushings (B1 and B2) which are subsequently attached to the pins provided with each bracket (20 and 22) to allow for the rotation of the tube. The bushings therefore provide for the pivoting of the tube while the spring is attached to the pivot (20*b* and 22*b*) and allows for pre-winding of the roller screen to a pre-determined tension to ensure that it will return to its fully accumulated position.

Figure 12:
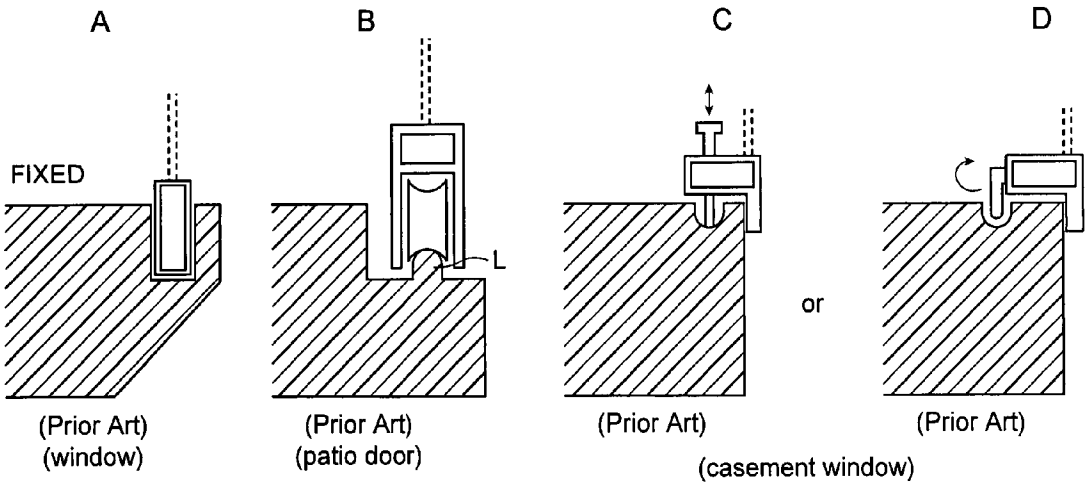
FIGS. 12 A, B, C, and D are a series of prior art hardware and planer screen schematic views for various closure assemblies.
Figure 13:
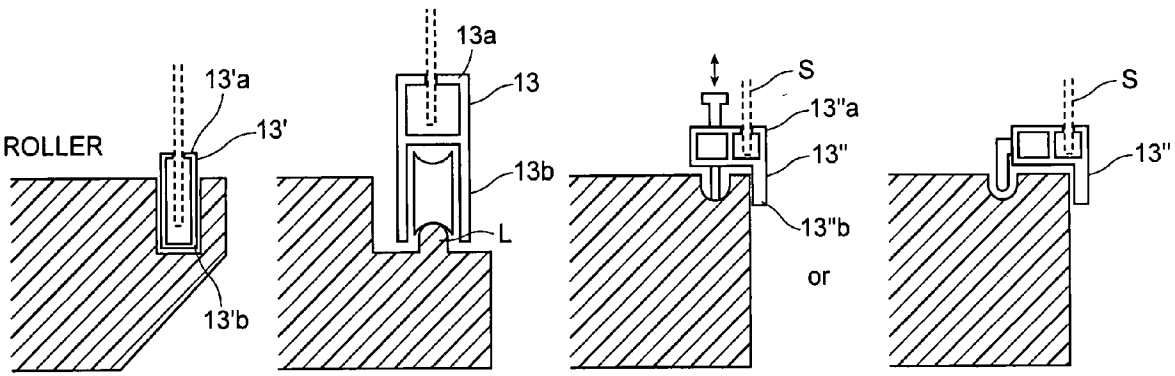
FIGS. 13 A, B, C, and D are a series of schematic views of various embodiments of the invention in engagement with similar hardware to that of FIG. 12 but incorporating Applicants' invention.

Referring now to FIGS. 12 and 13 there is illustrated examples of the various forms which the present invention may take without intending any limitation being derived by the reader in providing these examples. With regard to FIG. 12 there is illustrated corresponding sections found in prior art installations typical for a slider window, for example A, wherein a channel is provided within which a typical screen frame fixed in position. However, the screen frame blocks the view of the individual as it is permanently placed in position until such time as it is removed. As seen in FIG. 13A, the present invention provides for a combination of the screen including a frame which engages the same channel section in the prior art window of FIG. 12A, and yet provides with the same frame section, the movement of the roll screen to and from the housing (14) to allow for the occupant to have the screen in place when the window is open and have the screen out of view when the window is closed. This may be accomplished utilizing the same window channel provided in known window and typically slider window constructions.

Referring now to FIG. 12B, there is illustrated a typical rail of a patio door having a section (L) which engages a roller attached to a frame section which also has permanently installed therewith a screen. With regard to FIG. 13B, the present invention includes and provides with the framing section and the assembly 10, as seen and described in relation to the prior figures, a roller within section (13*b*) which engages the known rail (L) within channel section (13*b*), and wherein in addition the free end (31) of the roll screen is movable within the channel (13*a*) of Section 13. The same advantages are described in relation to FIG. 13A and are realized therefore as well with the patio door screen embodying the invention. The screen frame may roll on the rail (L) and the screen may be guided to and from an accessible position to a position wherein the screen is out of view.

Referring now to FIG. 12C or 12D there is illustrated a typical casement window planer screen which is attached to a framing section permanently and would permanently block the view of an occupant through the casement window. The planer screen is released via a pin release in FIG. 12C or with a pivot pin in FIG. 12D moved in the directions indicated. Utilizing the same channels and stops therefore the present invention in FIGS. 13C and 13D provide for placing of a casement screen of the present invention in exactly the same manner as with the prior art constructions with the additional combination heretofore unknown of the framing section (13") including portions (13"*b*) for engaging the known hardware within the frame section and section (13"*a*) for providing for the guiding channel of the free end of a roll out screen assembly which has been integrated therewith.

As is normally required it is highly recommended that sealing portions (not shown) be provided for sections 12 and housing 14 disposed along the entire outside vertical edges thereof.

Figure 11D:
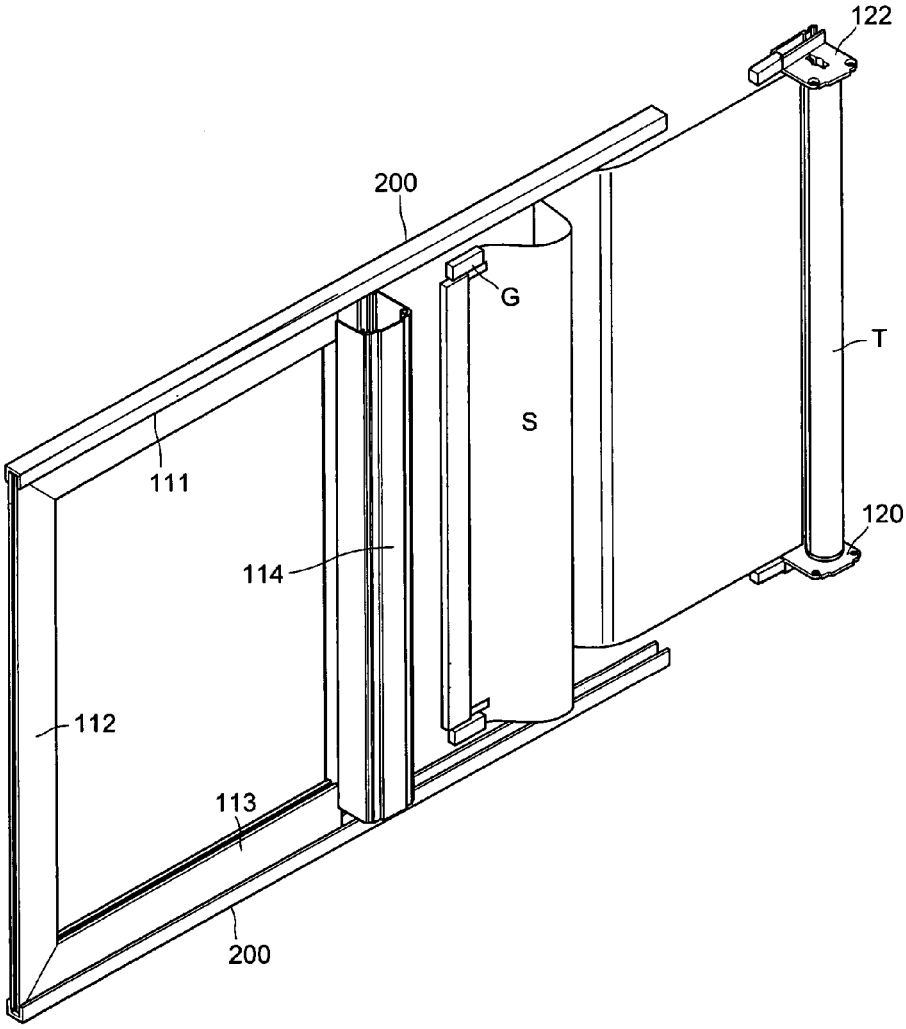
Figure 11E:
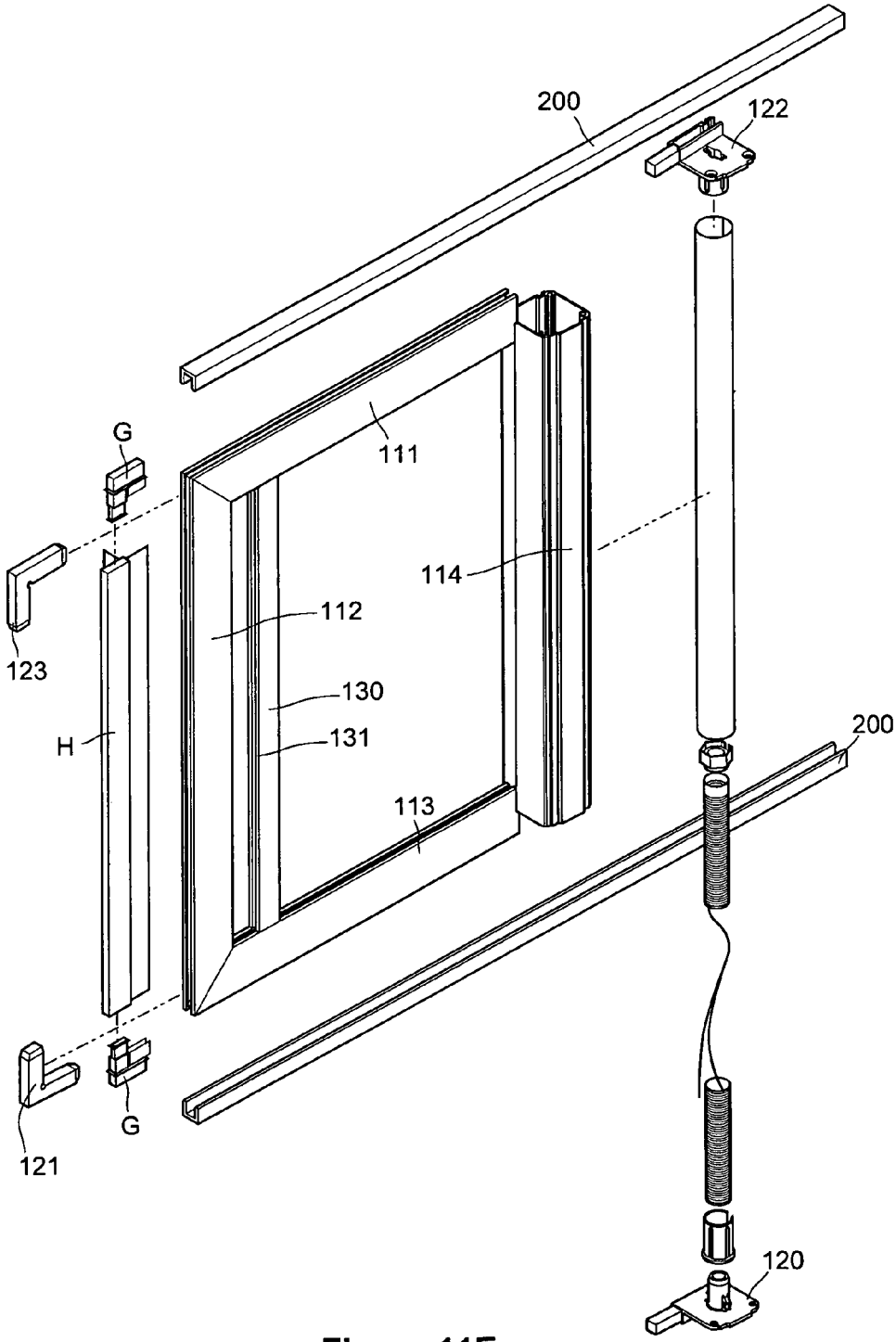

Referring now to FIGS. 1A, 2A, 3A, 4A, 6A, 7A, 8A, 9A, 10B, 10C, 11E and 11D there is illustrated the screen assembly (100) similar in all respects to screen assembly (10) as previously described with the difference being that the screen assembly (100) does not roll or slide within a track. The screen assembly (100) which includes sections (111, 112, 113) and housing (114) supported on brackets (120 and 122) and further assembled with the assistance of brackets (121 and 123) consistent with the previous patio door example, and utilizing the similar bracket (122) for example in FIGS. 6A and 7A which includes a leg (122*x*) which will be inserted within the framing sections (113 and 111) to assist with the assembly of the embodiment. As best seen in FIGS. 11C, 11D and 11E the conventional unshaped section (200) is provided in a window assembly frame to which the window screen (100) will engage in a manner as shown in relation to FIGS. 10B and 10C consistent with previously described patio door embodiment with the section (200) being engaged by the leg (122*b*) of the window screen (100) having a roll screen as seen in FIG. 11E contained within the housing (114) identical to FIG. 11A in all respects except that it is now a window screen as opposed to a patio door screen. Therefore, FIGS. 11B and 11E are comparable and the reader is referred thereto for like parts, and the operation thereof with the exception of the sliding. The descriptions are very much the same. The essence therefore, is that the window screen assembly (100) will interfit within the frame section (200) provided adjacent the header and sill of a window closure assembly with the invention (100) including the roll out screen within housing (114) being guided via guides (g) within frame elements (111*a* and 113*a*) to and from the accumulated and the employed position. When the window screen requires replacement or repair, it can easily be removed from the channel (200), repaired or replaced by dropping the new screen or repaired screen in position.

The window embodiment of window screen (100) may also be utilized with the other examples provided in FIGS. 13A, B and C. A man skilled in the art would understand what minor modifications would have to be made to do so.

Figure 15:
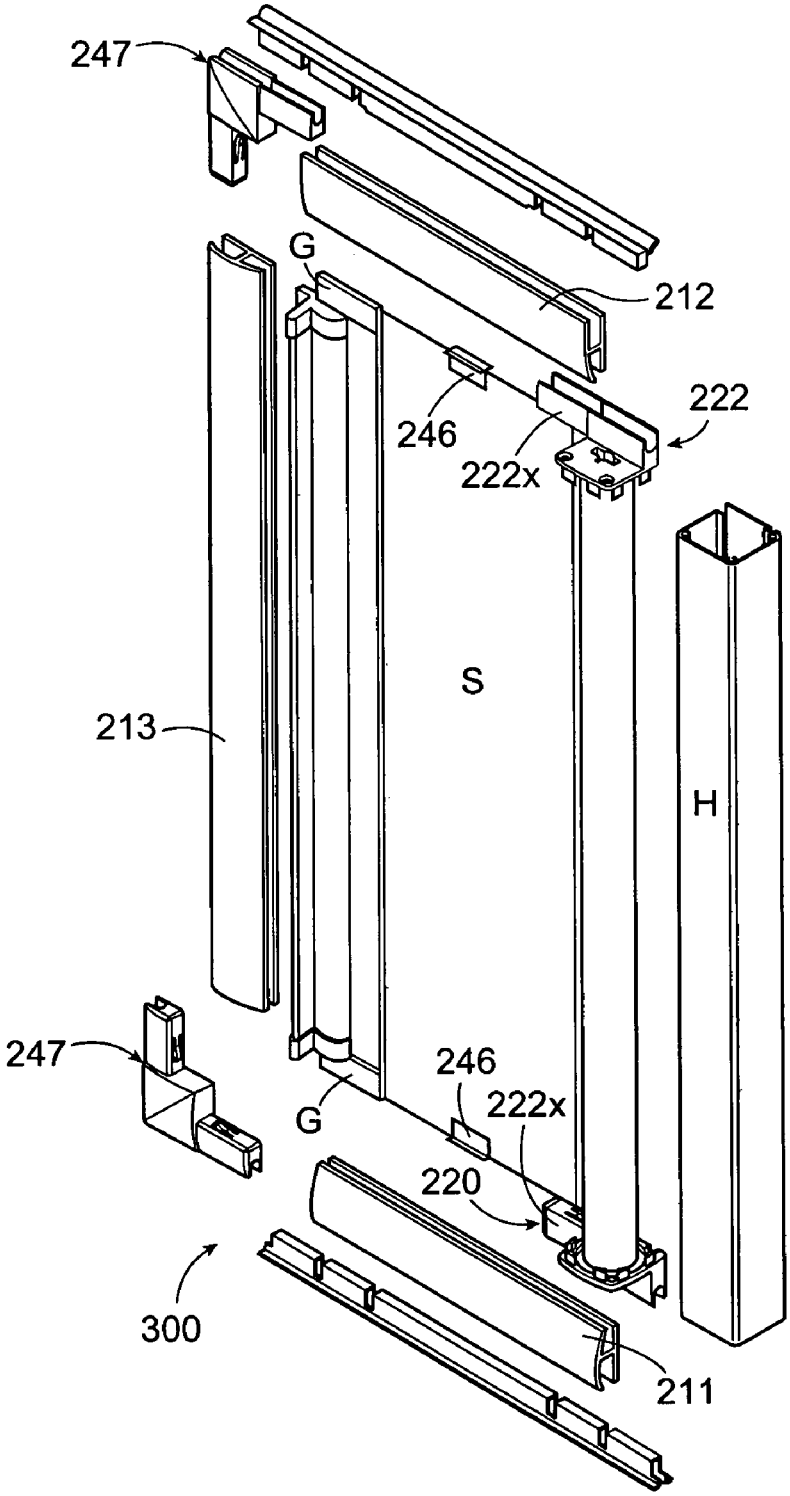
FIG. 15 is an exploded perspective view of an improved embodiment of a roll screen assembly incorporating a wind retainer and a mitreless corner connector, and illustrated in a preferred embodiment of the invention.
Figure 16:
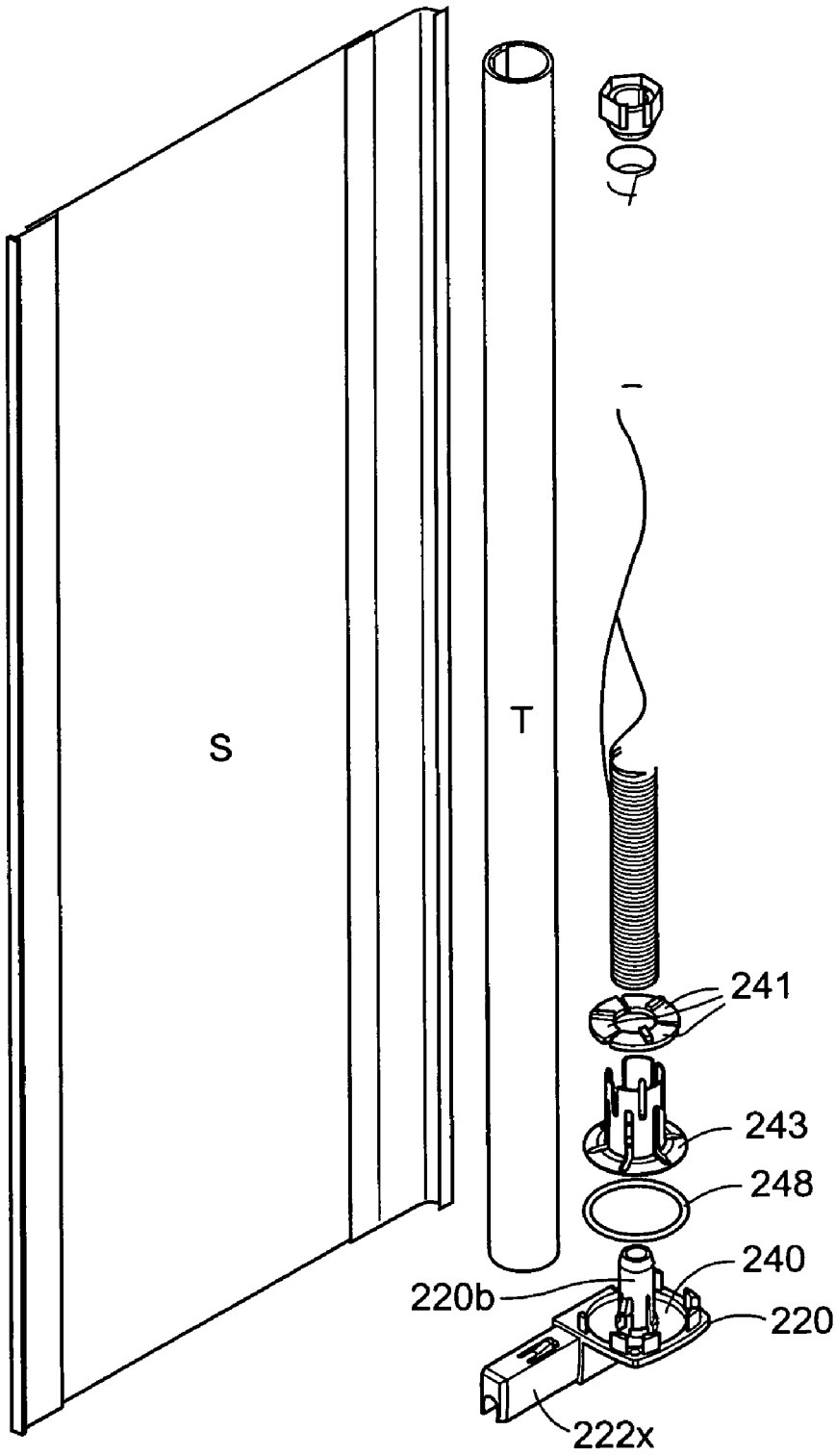
FIG. 16 is an exploded perspective view of the components of the roll screen assembly and bracket assembly illustrating the details of the centrifugal braking system, and illustrated in a preferred embodiment of the invention.

Referring now to FIG. 15, there is illustrated a screen assembly (300) similar in all respects to the screen assembly (10 and 100) as previously described with the additional incorporation of wind retaining device (246), mitreless corner bracket or connector (247) and centrifugal braking system as best seen in relation to FIG. 16. The screen assembly (300) includes sections (211, 212, 213) and a housing "H" for containing the screen supported on brackets (220,222). The framing sections (211,212,213) do not have typical mitre cuts as seen in FIG. 1 and are interconnected at right angles using a mitreless corner bracket 247. The brackets (220, 222) are similar to those previously described which includes leg (222*x*) which will be inserted within the framing sections (211, 213) to assist with the assembly of the screen frame. The wind retaining devices (246) are connected by known (preferably heat) welding techniques along the edge of the screen cloth (S) at predetermined positions and rides in the same U-shaped track as the guides (G).

Figure 17:
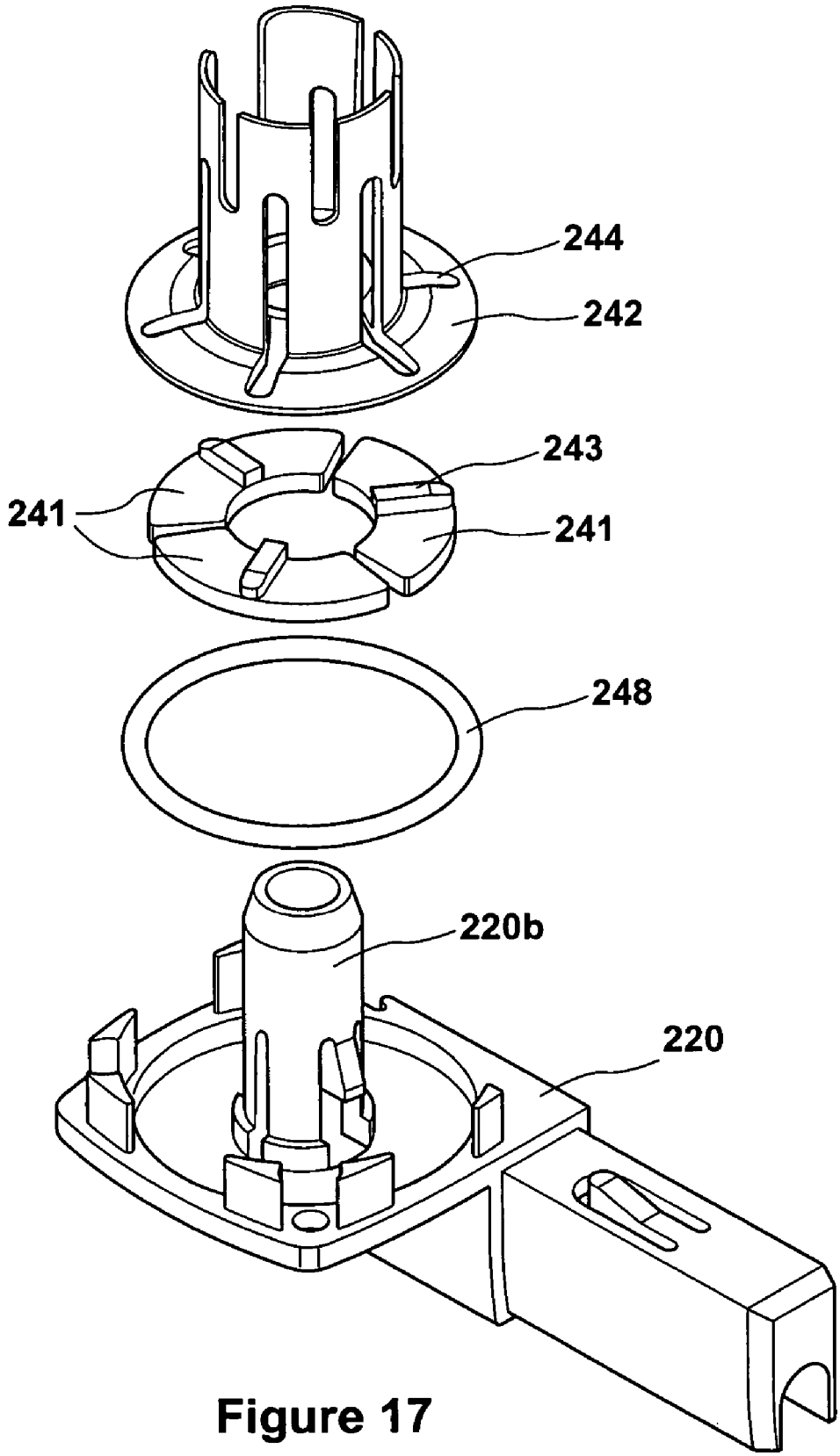
FIG. 17 is an exploded view of the bracket assembly, of FIG. 16, illustrating the assembly of the centrifugal braking system illustrated in a preferred embodiment of the invention.

In this way the screen cloth is guided to and from the retracted position with the additional assistance of the wind retainer 246. The operation of the centrifugal braking device is best understood by referring to FIGS. 16 and 17. Integrally formed within the brackets (220 and 222) is a circular depression (240) into which an O-ring (248) made of suitable material, such as rubber, can be frictionally and fixably inserted. The circular depression 240 is coaxial with the pivot (220*b*) and further contains three centrifugal braking elements (241). The braking elements (241) do not interfit tightly but are so designed that when placed within the circular depression (240), they have the ability to move radially, towards and away from the O-ring 248, and the pivot 220*b*. Each braking element (241) is operably connected to a bushing (242) by the use of a detent (243). Each detent (243) interfits with an associated notch or recess (244) located in the bushing (242). The detents (243) and recesses (244) are aligned when assembled to the circular depression (240) so as to allow the brake element (241) to slide in a radial direction towards and away from "O" ring 248. The collar part 242*a* of the bushing 242 covers the opening 240 when the brake elements 241 are contained therein. The bushing (242) is then inserted into and fixably secured to the roll tube (T) that carries the screen (S). When the screen is therefore retracted the roll tube T and attached free wheeling bushing (242) rotate allowing the braking system defined by the recess (244), the braking elements (241) captured by recesses 244 to also rotate. At a predetermined speed the brake elements 241 will move in a controlled manner as the detents (243) and recess (244), allow the braking elements (241) to slide radially by centrifugal force to frictionally engage the O-ring (248) thus causing the bushing to reduce speed, which is free to move on support 220*b*, and thereby cause the screen tube T to slow in angular speed and resulting in a braking force to slow the speed of retraction of the screen as it accumulates on the tube T and prevent runaway thereof. In any other respects, this assembly functions in a similar manner to the original embodiments described previously in the parent application.

Figure 18A:
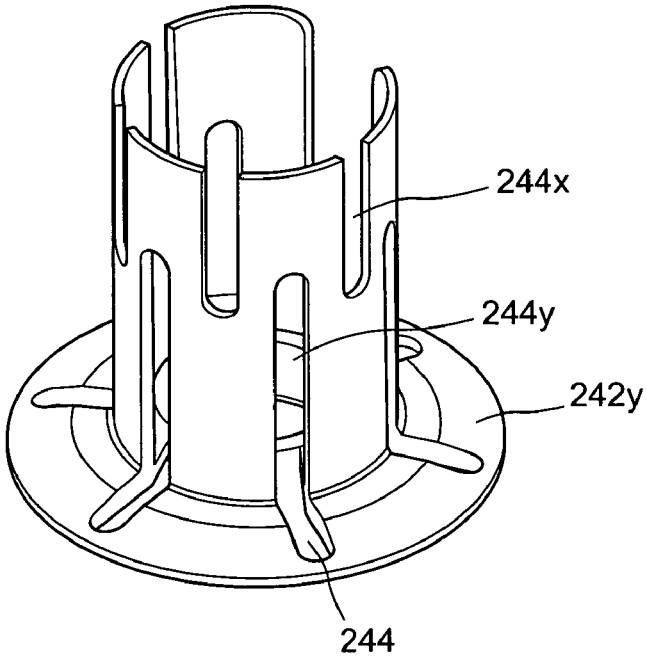
FIGS. 18 A, B, C, D are views of the bushing of FIG. 17 used to connect the roll screen to the bracket, and provide top, bottom, side, and cutaway views of the braking system thereof illustrated in a preferred embodiment of the invention.
Figure 18B:
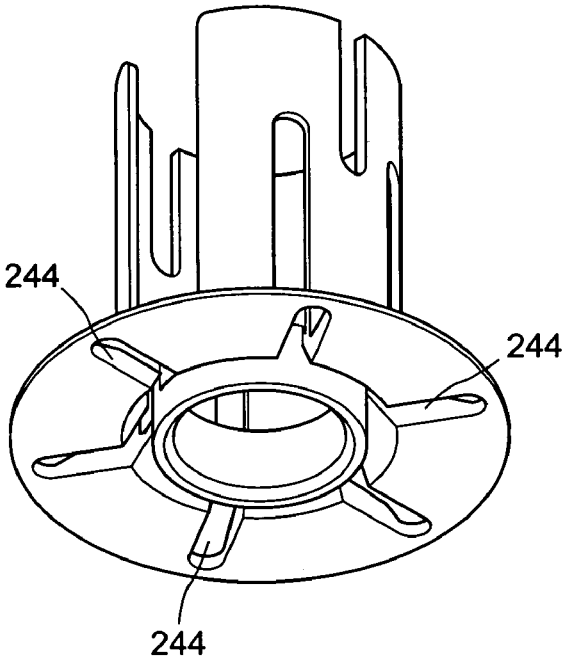
Figure 18C:
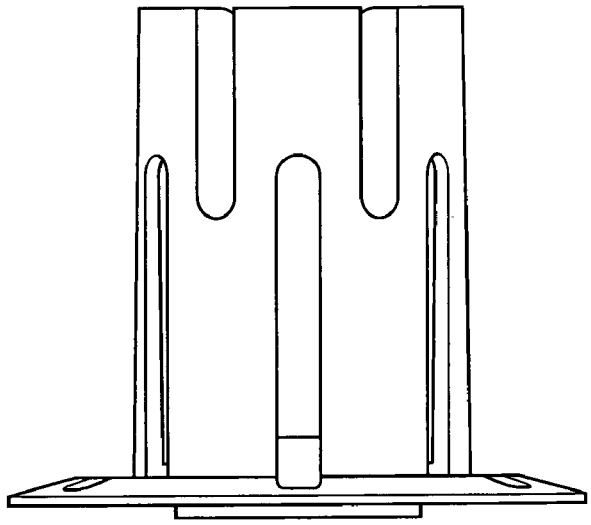
Figure 18D:
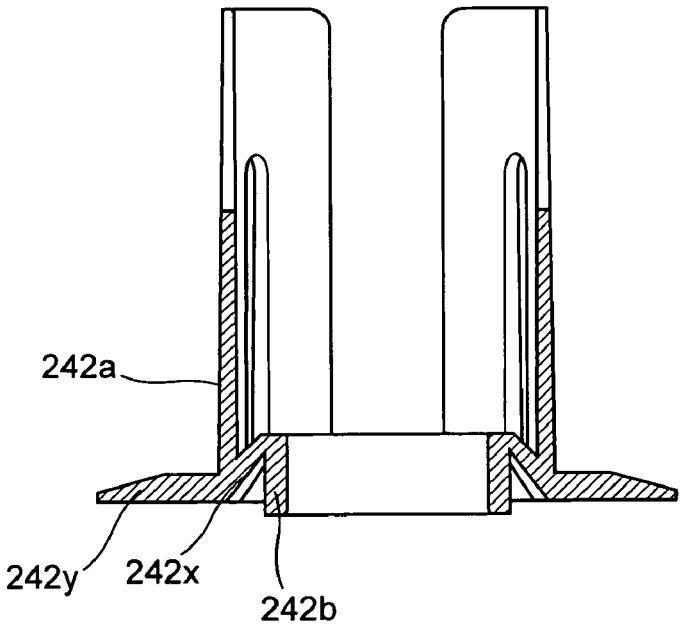
Figure 19A:
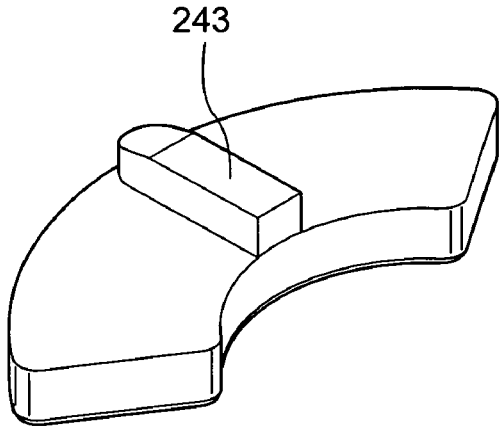
FIGS. 19 A, B, C, D, E are perspective, top and bottom views of the braking element used in the centrifugal braking system and illustrated in a preferred embodiment of the invention.
Figure 19B:
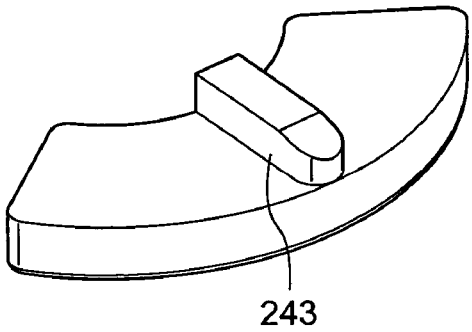
Figure 19C:
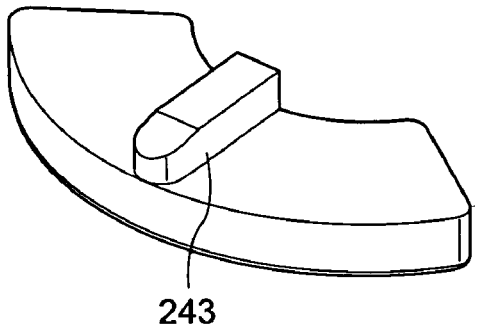
Figure 19D:
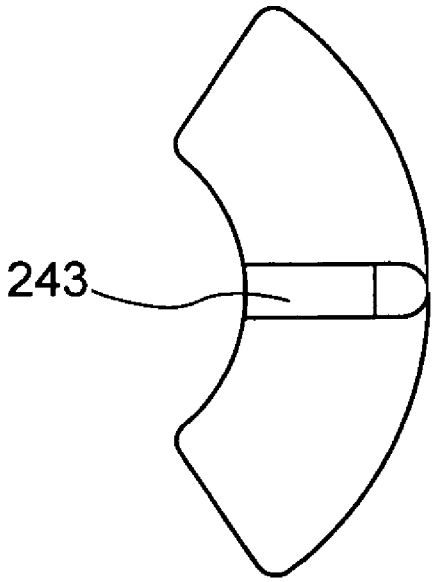
Figure 19E:
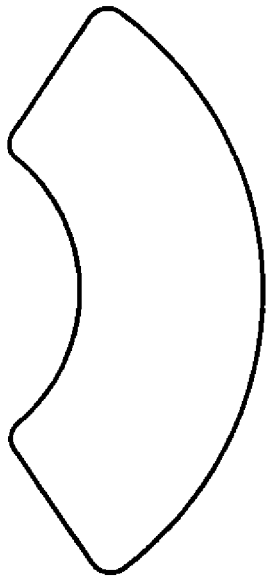

Referring now to FIGS. 18A, B, C and D and FIGS. 19A, B, C and D and E there is illustrated the bushings (242) and braking elements (241) with their recesses (244) and detents (243) that allow the radial sliding of the brake elements (241) at above a predetermined speed, to control the speed of retraction of the screen as described above.

The bushing 242 aside from including slots 242 also includes slots 244*x*, and 244*y* to permit over all flexibility of the bushing to snuggly capture the roll tube "T" and engage the support 220*b*. In fact portion 242*b* attaches over the support part 220*b* to provide the free wheeling of the torque tube 242. A substantially "Z" shaped portion 242*x* separates portion 242*b* from side portion 242*a* to allow for flexing of these flanges, and preferably allows a 0.010 inch variation in the size of screen tube hollow.

Figure 20A:
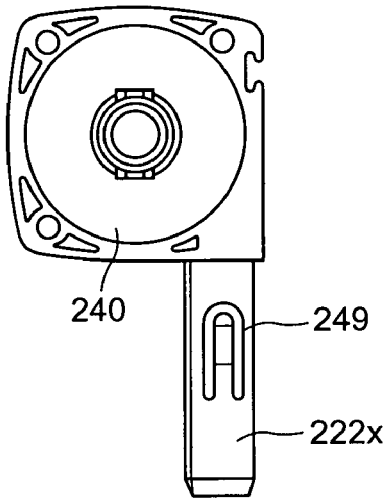
FIGS. 20 A, B, C, D, E, F are top, bottom, perspective, side, and end views of the body of the bracket, illustrated in a preferred embodiment of the invention.
Figure 20B:
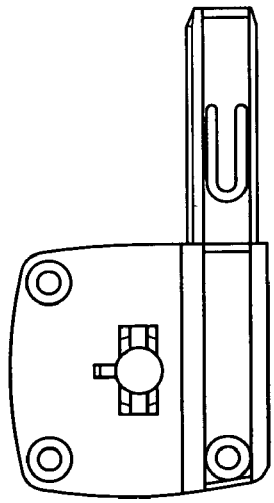
Figure 20C:
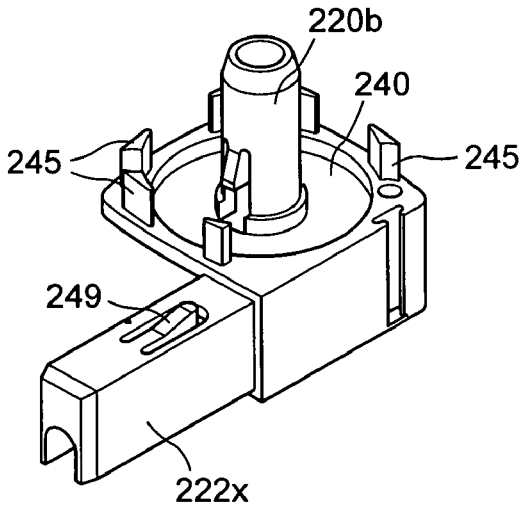
Figure 20D:
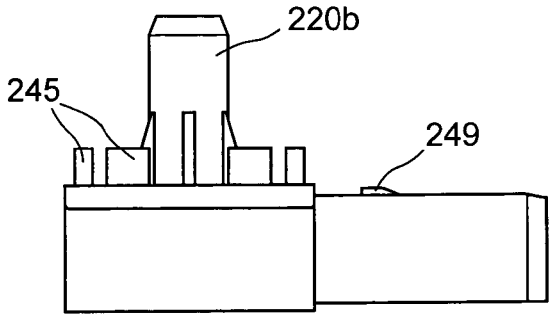
Figure 20E:
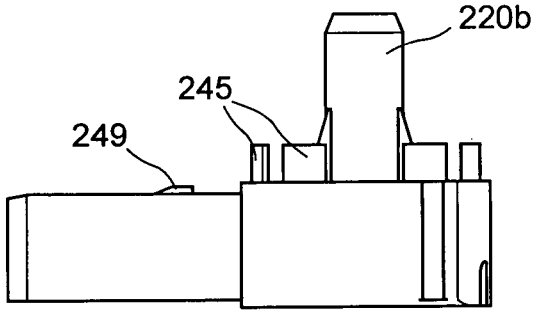
Figure 20F:
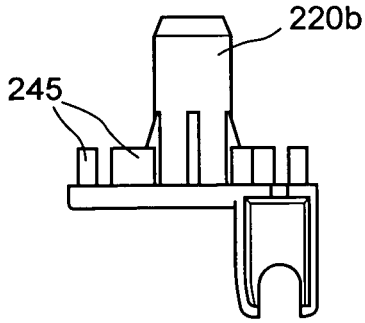

Referring now to FIGS. 20A, B, C, D and E, there is illustrated bracket 220 for the roll screen used in conjunction with the centrifugal braking system described previously. The bracket 220 is asymmetrical thus it is possible to have both right and left handed versions for the top and bottom of the screen assembly as seen in FIGS. 20A and 20F. A circular depression (240) is provided that is coaxial to the pivot (220*b*) and integrally formed with the bracket. In this particular embodiment, there are additional detents used for locking the leg (222*x*) of the bracket to the framing sections (211, 213). There is also contained spacing guides (245) used for the correct placement and orientation of the housing (214) onto the tube "T".

Figure 21A:
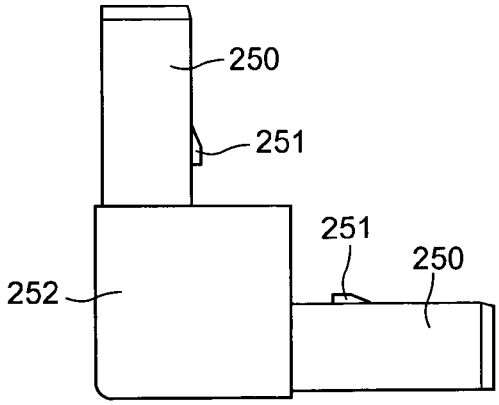
FIGS. 21 A, B, C, D are end, top, and side perspective views of the mitreless corner connector for attaching the various framing element to one another and illustrated in a preferred embodiment of the invention.
Figure 21B:
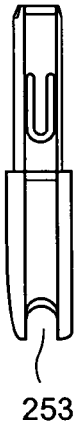
Figure 21C:
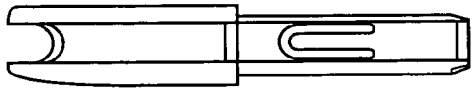
Figure 21D:
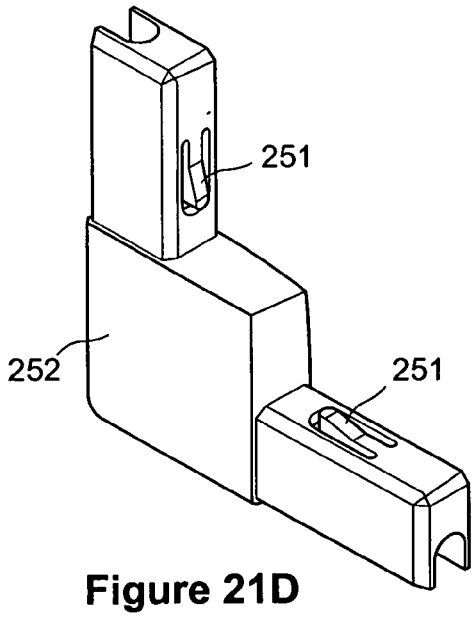

Referring now to FIGS. 21A, B, C and D, there is illustrated the mitreless corner bracket used in the present invention. The mitreless corner bracket contains two legs (250) that are substantially perpendicular to one another. Each leg contains a locking detent (251) for attachment to the framing sections (211,212, 213) previously described. At the corner where the two legs would normally meet is a block (252). The width and thickness of this block is dependent on the corresponding dimensions of the associated framing section (211, 212, 213) that is being attached to each leg (250) of the corner bracket. The block (252) allows the use of framing sections that are square cut and when a framing section is attached to each leg, a corner for the frame can be achieved without the need for a mitre cut. The corner bracket may also contains a U groove (253) that allows the entire framing section with the bracket to engage and/or slide within a rail in a conventional manner as previously described.

Figure 22A:
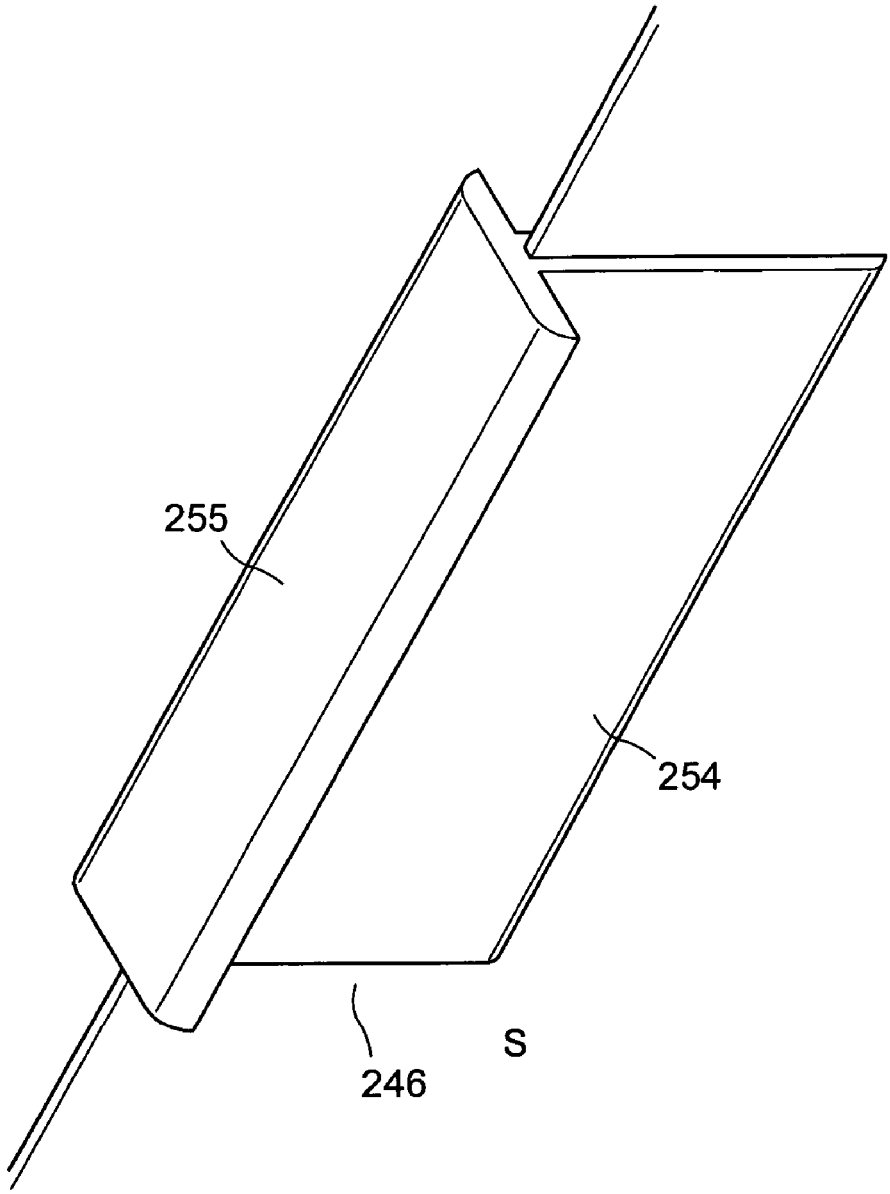
FIGS. 22A, and B are perspective views of the flexible wind retainer for attachment to the screen cloth, and illustrated in a preferred embodiment of the invention.
Figure 22B:
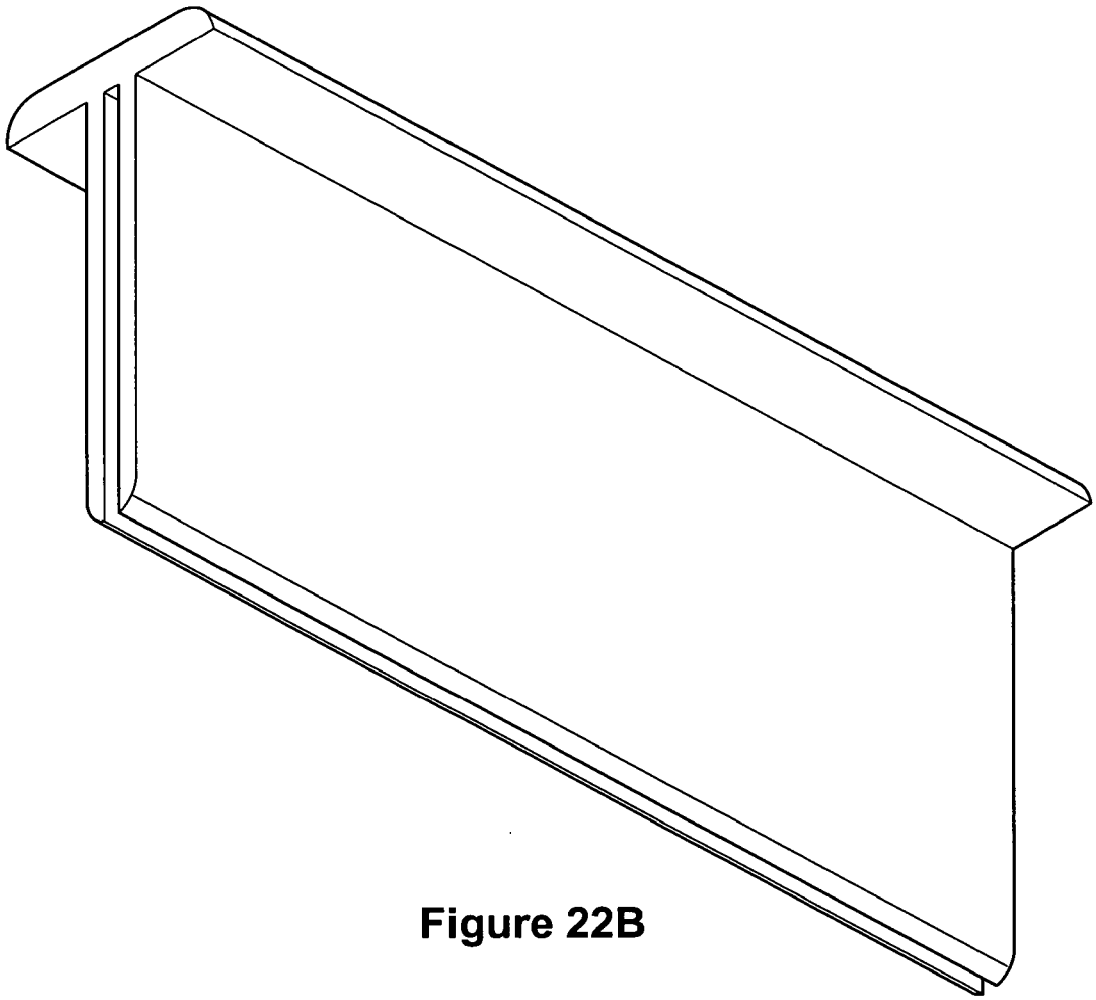
Figure 23:
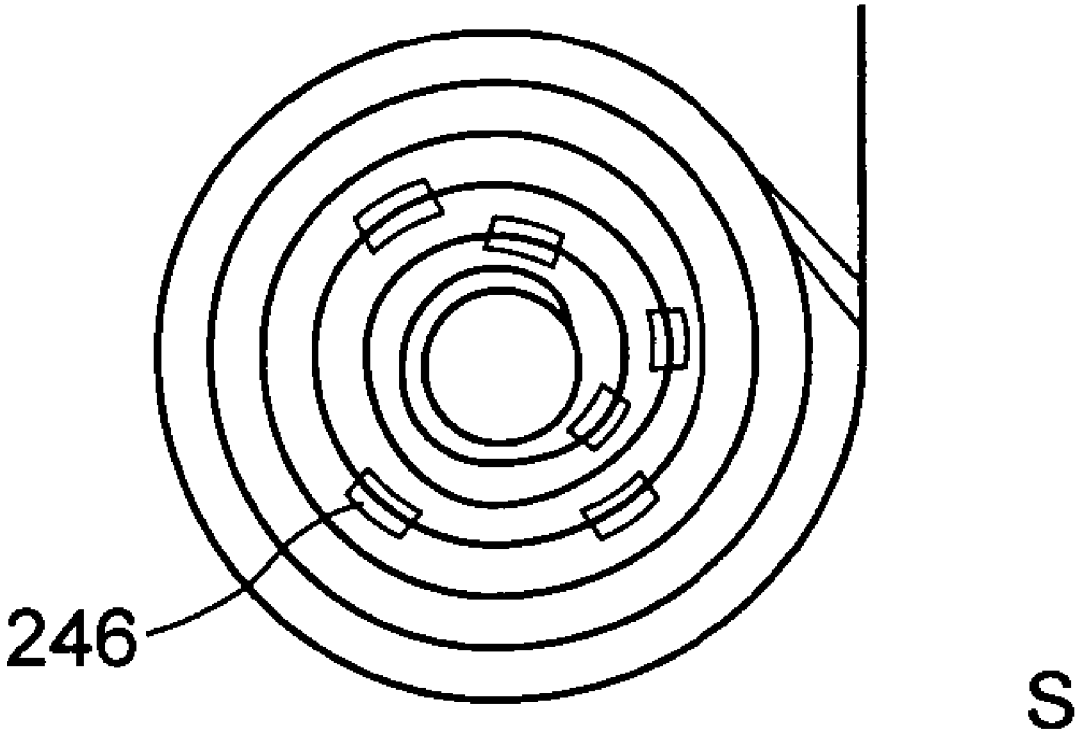
FIG. 23 is a top schematic view of the roll screen with attached wind retainers showing the accumulation of the screen and the wind retainers when the screen is in a retracted positioned illustrated in a preferred embodiment of the invention.

Referring now to FIGS. 22A and 22B and 23, there is illustrated the wind retaining member 246 of FIG. 15. The wind retainer is made of a flexible material and is affixed to the screen (S) by welding, preferably heat welding, as previously described. The wind retainer 246 contains screen engaging portions (254) and a track engaging portion (255). The screen engaging portions (254) when compared to the track engaging portion (255) of the wind retainer has a larger dimension so as to distribute any forces over a large enough area to prevent the tearing of the screen (S) adjacent the welded area. The relatively small size of the track engaging portion (255) and the rounded corners thereof also serves an additional purpose as described hereafter. The track engaging portion (255) is perpendicular to the screen engaging portion (254) and rides within the same track as the guide G described previously. When the screen is retracted, the flexibility and small thickness of screen engaging portions 254 attached to the track engaging portion (255) allows the wind retainers and the screen to which they are attached to be fully and smoothly accumulated onto the roll screen tube "T" in the housing (H) with the track engaging portion 255 riding above/below the screen itself (S) as best seen in FIG. 23. Any additional bulk to the resulting spiral of roll screen (S) would only be the thickness of the screen engaging portion (254), which is very thin. FIG. 23 illustrates the roll screen accumulated on tube "T" illustrating the track engaging portions disposed above the end on the retracted screen accommodated in housing H.

Therefore, in essence the present invention provides for a combination of improvements and features heretofore unknown allowing for installation of the various forms of the invention within the hardware and channel portions already provided with known window constructions, patio door constructions, and casement window constructions. The illustrations and descriptions in relation to the figures are for illustrative purposes only and in no way limit the invention.

As many changes can be made to the preferred embodiments of the invention without departing from the scope thereof. It is intended that all matter contained herein be considered illustrative of the invention and not it a limiting sense.

The embodiments of the invention in which an exclusive property or privilege is claimed are as follows:

1. A sliding screen frame for a closure assembly having an opening and an existing track for mounting a screen, said screen frame comprising framing sections having an outer side edge and an inner side edge, and a screen housing from which a screen is payed out and accumulated, said framing sections being adapted proximate the outer side edge to interfit with the existing track of the closure assembly to enable the sliding screen frame to slide across the opening of the closure assembly and the frame sections also being adapted proximate the inner side edge thereof to support and guide the free end of the screen between a fully payed out and a fully accumulated position, further comprising a mitreless corner connector having a generally "L" shaped member including two perpendicular legs extending from a central box shaped part, at least one of said legs comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for mitre cuts thereof and said box shaped part for butting with the adjacent framing sections when joined to said connector to establish continuity with the adjacent edges of said sections.

2. A sliding screen frame for a closure assembly having an opening and an existing track for mounting a screen, said screen frame being moveable between a position wherein the screen frame blocks the opening to a second position wherein one is able to pass through the opening, said screen frame comprising framing sections having an inner and outer side edge and a screen housing from which a screen is accumulated and payed out, said framing sections being adapted proximate the inner side edge to support and guide the free end of the screen, and the outer side edge being adapted to engage with the existing tracks of the closure assembly, wherein said screen is moveable across the screen frame from an accumulated position within the housing, to a fully payed out extended position, the free end of the screen riding within the inner side edge of the framing section, said screen frame being moveable to and from a position blocking said opening as said outer side edge of the framing section engages the existing track of the closure assembly, further comprising a mitreless corner connector having a generally "L" shaped member including two perpendicular legs extending from a central box shaped part, at least one of said legs comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for miter cuts thereof and said box shaped part for butting with the adjacent framing sections when joined to said connector to establish continuity with the adjacent edges of said sections.

3. A screen frame for a closure assembly having an existing track for mounting a frame, said screen frame comprising framing sections and a housing for paying out and accumulating a screen, said framing sections having an inner and outer side edge, said inner side edge including guides provided therewith, the screen being moveable in said guide of the inner side edge of the framing sections between a fully extended position, whereat the screen is substantially payed out from said housing, and a fully retracted position within the housing; said framing section also being adapted, proximate the outer side edge thereof to engage with the existing track disposed with the closure assembly whether the screen is at the fully extended or the fully retracted position, further comprising a mitreless corner connector having a generally "L" shaped member including two perpendicular legs extending from a central box shaped part, at least one of said legs comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for mitre cuts thereof and said box shaped part for butting with the adjacent framing sections when joined to said connector to establish continuity with the adjacent edges of said sections.

4. A sliding screen frame for a closure assembly including an opening and having an existing track for mounting a screen, said screen frame comprising framing members connected with a roll out screen housing, said framing members having an inner and an outer side edge and being adapted proximate the outer side edge to allow said screen frame to slide across the closure assembly opening, said framing members also being adapted proximate the inner side edge thereof to support a free end of a roll screen to and from a payed out position, further comprising a mitreless corner connector having a generally "L" shaped member including two perpendicular legs extending from a central box shaped part, at least one of said legs comprising a locking detent for lockably connecting said connector to one of said framing members, said locking detent comprising a flexible portion in said leg, one end of said flexible portion having a gradually elevating profile that increases towards the other end of said flexible portion, said connector for connecting adjacent framing members without the need for miter cuts thereof and said box shaped part for butting with the adjacent framing members when joined to said connector to establish continuity with the adjacent edges of said members.

5. The screen frame of claim 4 further comprising rollers to assist with the sliding motion of the screen frame across the opening on the existing track of the closure assembly.

6. The screen frame of claim 5 wherein the rollers are included with a support bracket for supporting the roll screen in said housing.

7. The screen frame of claim 6 wherein the support bracket includes a section to engage the framing members proximate the corners of the screen frame to assemble the members into the screen frame and to house the rollers for movement of the frame on the existing track of header and sill sections of the closure assembly.

8. The screen frame of claim 7 wherein the bracket also includes supports disposed with the brackets, opposite the rollers to engage a roll tube upon which roll screen is accumulated.

9. A screen frame for a closure assembly having an existing track, said screen frame comprising framing sections and a screen housing, each section including, an inner portion adapted as a support and guide for the free end of a screen payed out from said screen housing, and an outer portion adapted to engage with the existing track of the closure assembly whether the screen is at a fully payed out or a fully accumulated position, wherein said screen frame may be installed in the existing track of the closure assembly without the need of tools, further comprising a mitreless corner connector having a generally "L" shaped member including two perpendicular legs extending from a central box shaped part, at least one of said legs comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for mitre cuts thereof and said box shaped part for butting with the adjacent framing sections when joined to said connector to establish continuity with the adjacent edges of said sections.

10. A frame section for a screen frame to be interconnected with like sections and including a screen housing from which a screen is payed out and accumulated, said frame section comprising an outer edge portion adapted for engagement with existing tracks of a closure assembly, and an inner edge portion adapted to support and guide the free end of the screen, further comprising a miterless corner connector having a generally "L" shaped member including two perpendicular legs extending from a central box shaped part, at least one of said legs comprising a locking detent for lockably connecting said connector to said frame section, said locking detent comprising a flexible portion in said leg, one end of said flexible portion having a gradually elevating profile that increase towards the other end of said flexible portion, said connector for connecting said framing section without the need for miter cuts thereof to another framing section and said connector to shaped part for butting with the adjacent framing sections when joined to said connector to establish continuity with the adjacent edges of said sections.

11. A kit of components for assembly of a screen frame comprising framing sections, a screen housing, and a screen accumulated and payed out from said housing, said framing sections being adapted to engage existing tracks of a closure assembly and also being adapted to guide and support the free end of the screen as it is payed out and accumulated from said screen housing, further comprising a mitreless corner connector having a generally "L" shaped member including two perpendicular legs extending from a central box shaped part, at least one of said leas comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for mitre cuts thereof and said box shaped part for butting with the adjacent framing sections when joined to said connector to establish continuity with the adjacent edges of said sections.

12. A kit of components for assembly of a screen frame comprising framing sections, a housing for a roll screen, and a roll screen, said kit for assembly to provide the screen frame of claims 1,2,3,4,9, and 10.

13. A screen frame construction for a closure assembly comprising framing sections having an inner and outer side edge, and a screen housing from which a screen is payed out and accumulated, said frame sections being adapted proximate the outer side edge to interfit with existing tracks of the closure assembly, and said framing sections being adapted proximate the inner side edge to support and guide a screen as it is payed out from the housing, further comprising a mitreless corner connector having a generally "L" shaped member including two perpendicular legs extending from a central box shaped part, at least one of said legs comprising a locking detent for lockably connecting said connector to one of said framing sections, said locking detent comprising a flexible portion in said leg, one end of said flexible portion having a gradually elevating profile that increases towards the other end of said flexible portion, said connector for connecting adjacent framing sections without the need for mitre cuts thereof and said box shaped part for butting with the adjacent framing sections when joined to said connector to establish continuity with the adjacent edges of said sections.

14. The screen frame of claim 13 wherein said screen is a roll screen.

15. The screen frame of claim 2, 9, or 13 wherein the closure assembly is a casement window.

16. The screen frame of claim 1, 2, or 4 wherein the closure assembly is a sliding window.

17. The screen frame of claim 2, 9, or 13 wherein the closure assembly is a tilt and slide window.

18. The screen frame of claim 2, 9, or 13 wherein the closure assembly is a double hung window.

19. The screen frame of claim 1, 2, or 4 wherein the closure assembly is a patio door.

20. The screen frame of claim 2, 9, or 13 wherein the closure assembly is a pivoting door.

21. The screen frame of claim 2, 9, or 13 wherein the closure assembly is an awning window.

22. A retainer for installation adjacent the edge of a screen cloth and releasably insertable into a guide channel for a screen assembly for guiding the motion of said screen cloth in said guide channel, said retainer comprising a head part extending away from the edge of said screen cloth and two flange parts extending from said head part at substantially ninety degrees, and capturing there-between the screen cloth which is fastened thereto, said flange parts being made of flexible material, said retainer allowing the screen cloth to roll up flat when retracted and does not allow the accumulated screen to go out of round in doing so and whereby said retainer is releasable from said guide channel when subjected to a predetermined force.

23. A torque tube for fastening to a hollow shaft proximate one end and for engaging a support bracket for the hollow shaft at the other, wherein the torque tube is adapted to be free wheeling on said support bracket, said tube having a substantially "Z" shaped flange to interconnect the end for engaging the hollow shaft with the end for engaging the support bracket, wherein said "Z" shaped flange permits flexing of the torque tube to accommodate a predetermined variation in said hollow shaft and wherein the torque tube tightens if efforts are made to separate the shaft and the torque tube.

24. A miterless corner connector comprising a generally "L" shaped member including two perpendicular legs extending from a central box shaped part, at least one of said legs comprising a locking detent for lockably connecting said connector to a framing section, said locking detent comprising a flexible portion in said leg, one end of said flexible portion having a gradually elevating profile that increases towards the other end of said flexible portion, said connector for connecting said framing section without the need for miter cuts thereof to another framing section and said box shaped part for butting with the adjacent framing sections when joined to said connector to establish continuity with the adjacent edges of said sections.

* * * * *